US012357052B2

(12) United States Patent
Buonome

(10) Patent No.: US 12,357,052 B2
(45) Date of Patent: Jul. 15, 2025

(54) FACE COVERING SPACER FOR USE WITH EYEWEAR AND HEADWEAR

(71) Applicant: Pleura, LLC, Nederland, CO (US)

(72) Inventor: Daniel Peter Buonome, Nederland, CO (US)

(73) Assignee: Pleura, LLC, Nederland, CO (US)

( * ) Notice: Subject to any disclaimer, the term of this patent is extended or adjusted under 35 U.S.C. 154(b) by 100 days.

(21) Appl. No.: 18/110,110

(22) Filed: Feb. 15, 2023

(65) Prior Publication Data

US 2023/0255300 A1 Aug. 17, 2023

Related U.S. Application Data

(60) Provisional application No. 63/310,564, filed on Feb. 15, 2022.

(51) Int. Cl.
*A42B 3/20* (2006.01)
*A41D 13/11* (2006.01)

(52) U.S. Cl.
CPC ..... *A42B 3/20* (2013.01); *A41D 13/1161* (2013.01)

(58) Field of Classification Search
CPC .... A41D 23/00; A41D 13/11; A41D 13/1107; A41D 13/1161
See application file for complete search history.

(56) References Cited

U.S. PATENT DOCUMENTS 1,279,884 A 9/1918 Roche
2,314,889 A 3/1943 Manson et al.
4,141,086 A 2/1979 Jackson
4,610,247 A 9/1986 Stroup
4,944,039 A 7/1990 Dietrich
5,836,303 A 11/1998 Hurst et al.
7,086,401 B2 8/2006 Chiam
7,725,949 B2 * 6/2010 Landis ..... A61F 9/045 2/9

(Continued)

FOREIGN PATENT DOCUMENTS

JP 2009293171 12/2009
KR 20160084714 A 7/2016

(Continued)

OTHER PUBLICATIONS

PCT International Patent Application No. PCT/US23/13130, International Search Report and Written Opinion of the International Searching Authority dated May 23, 2023, 15 pages.

(Continued)

*Primary Examiner* — Katherine M Moran
(74) *Attorney, Agent, or Firm* — Craig R. Miles; CR MILES P.C.

(57) ABSTRACT

Disclosed herein are embodiments of a spacer for spacing a face covering from a mouth of a wearer, the spacer including a first attachment point, a second attachment point, and a shape-retaining first support member outwardly and downwardly extending between the first and second attachment points. The first support member can be configured for disposition in front of the face of the wearer to distance the face covering from the mouth of the wearer to create a space therebetween. The first and second attachment points can be configured to releasably couple the first support member to eyewear and/or headwear.

16 Claims, 22 Drawing Sheets

(56) References Cited

U.S. PATENT DOCUMENTS

| | | | | |
|---|---|---|---|---|
| 8,387,216 | B1 | 3/2013 | Martinson | |
| 8,621,668 | B1 | 1/2014 | Nolz | |
| 8,733,357 | B2 | 5/2014 | Sullivan, Jr. | |
| 8,776,322 | B2 | 7/2014 | Martinson | |
| 8,794,682 | B2 | 8/2014 | Fiedler | |
| 8,806,723 | B2 | 8/2014 | Martinson et al. | |
| 10,278,866 | B2 | 5/2019 | Moore et al. | |
| 10,369,319 | B2 | 8/2019 | Formica et al. | |
| 10,455,871 | B2 * | 10/2019 | Pearce | A41D 13/1184 |
| 10,561,181 | B2 * | 2/2020 | Pearson | A41D 31/102 |
| 10,575,514 | B1 * | 3/2020 | Sasaki | G02C 7/10 |
| 11,324,264 | B2 * | 5/2022 | Chatzidakis | A41D 13/1107 |
| 11,400,323 | B2 | 8/2022 | Bernstein et al. | |
| 11,918,063 | B2 * | 3/2024 | Hill | A41D 13/1169 |
| 2007/0252946 | A1 | 11/2007 | Welchel et al. | |
| 2010/0319105 | A1 | 12/2010 | Fairbanks | |
| 2013/0340148 | A1 | 12/2013 | Arai | |
| 2014/0196200 | A1 | 7/2014 | Beliveau | |
| 2015/0026858 | A1 | 1/2015 | Ross et al. | |
| 2015/0027446 | A1 | 1/2015 | Brega | |
| 2015/0245675 | A1 | 9/2015 | Chinquee | |
| 2016/0029734 | A1 | 2/2016 | Kurpjuweit | |
| 2016/0213959 | A1 | 7/2016 | Barklow | |
| 2018/0035729 | A1 | 2/2018 | Pearson | |
| 2018/0338550 | A1 * | 11/2018 | Boulware | A41D 13/1161 |
| 2021/0345694 | A1 * | 11/2021 | Volk | A41D 13/1161 |
| 2022/0095734 | A1 | 3/2022 | Welch, Sr. et al. | |
| 2022/0132951 | A1 | 5/2022 | Roy | |
| 2022/0192291 | A1 | 6/2022 | Lawrence | |
| 2022/0305305 | A1 | 9/2022 | Johnson et al. | |
| 2022/0322767 | A1 * | 10/2022 | Hancock | A41D 13/1107 |

FOREIGN PATENT DOCUMENTS

| | | | |
|---|---|---|---|
| KR | 102284062 | B1 | 7/2021 |
| WO | WO2018097507 | | 5/2018 |

OTHER PUBLICATIONS

Amazon. 3D Mask Inner Bracket for Comfortable Mask Wearing . . . Website, https://www.amazon.com/Bracket-Comfortable-Breathing-Support-Breathing-Reusable/dp/B086X369N6?th=1, originally downloaded Mar. 10, 2023, 7 pages.

Burton. Men's Anon MFI® Lightweight Neck Warmer. Website, https://www.burton.com/us/en/c/anon-optics-mfi-facemasks, originally downloaded May 15, 2023, 8 pages.

La Sportiva. Stratos Mask. Website, https://www.lasportivausa.com, originally downloaded May 15, 2023, 2 pages.

Monocircus. Lanucal, a 3-dimentional support frame . . . Website, https://monocircus.com/en/lacunal.html, originally downloaded Mar. 10, 2023, 4 pages.

Youtube. Anon MFI® Magnetic Facemask Integration. Website, youtube.com/watch?v=gf5RYGv3DBI, originally downloaded May 15, 2023, 1 page.

Youtube. What is a MFI and Why You Need It for Your Anon Snow Goggle! SportRx. Website, https://www.youtube.com/watch?v=3KawSUWhBWw, originally downloaded Mar. 10, 2023, 3 pages.

* cited by examiner

FACE COVERING SPACER FOR USE WITH EYEWEAR AND HEADWEAR

I. SUMMARY OF THE INVENTION

A broad object of a particular embodiment of the invention can be to provide a spacer for spacing a face covering from a mouth of a wearer, the spacer including a first attachment point, a second attachment point, and a shape-retaining first support member outwardly and downwardly extending between the first and second attachment points. The first support member can be configured for disposition in front of the face of the wearer to distance the face covering from the mouth of the wearer to create a space therebetween. The first and second attachment points can be configured to releasably couple the first support member to eyewear and/or headwear.

II. BRIEF DESCRIPTION OF THE DRAWINGS

Figure 3A:
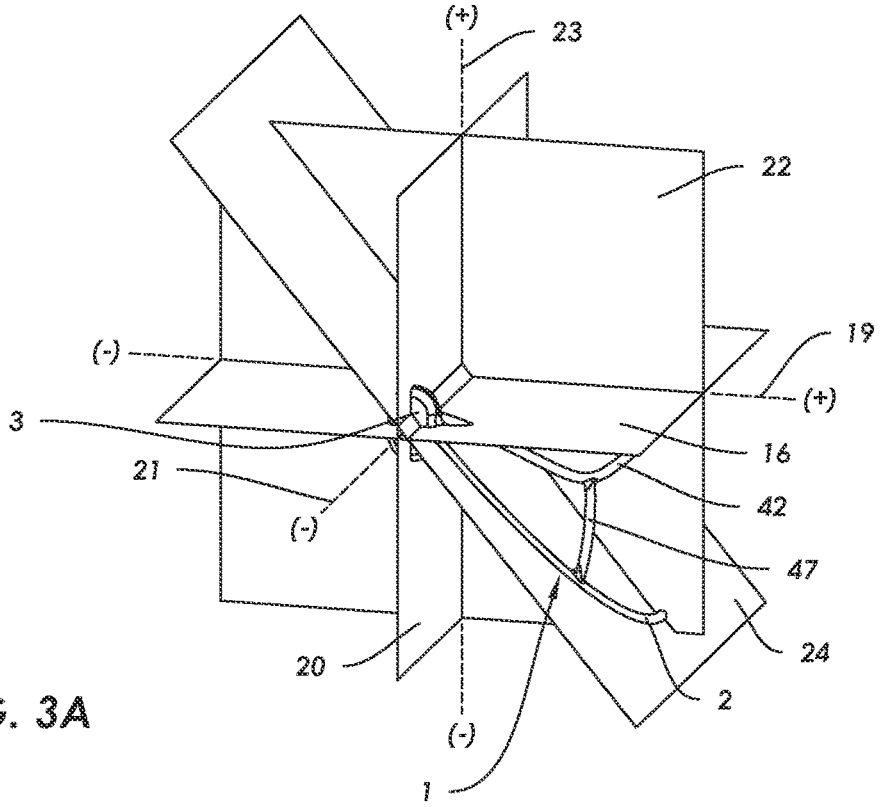
FIG. 3A is a perspective view of a particular embodiment of the inventive spacer, the view including reference planes and axes.
Figure 3B:
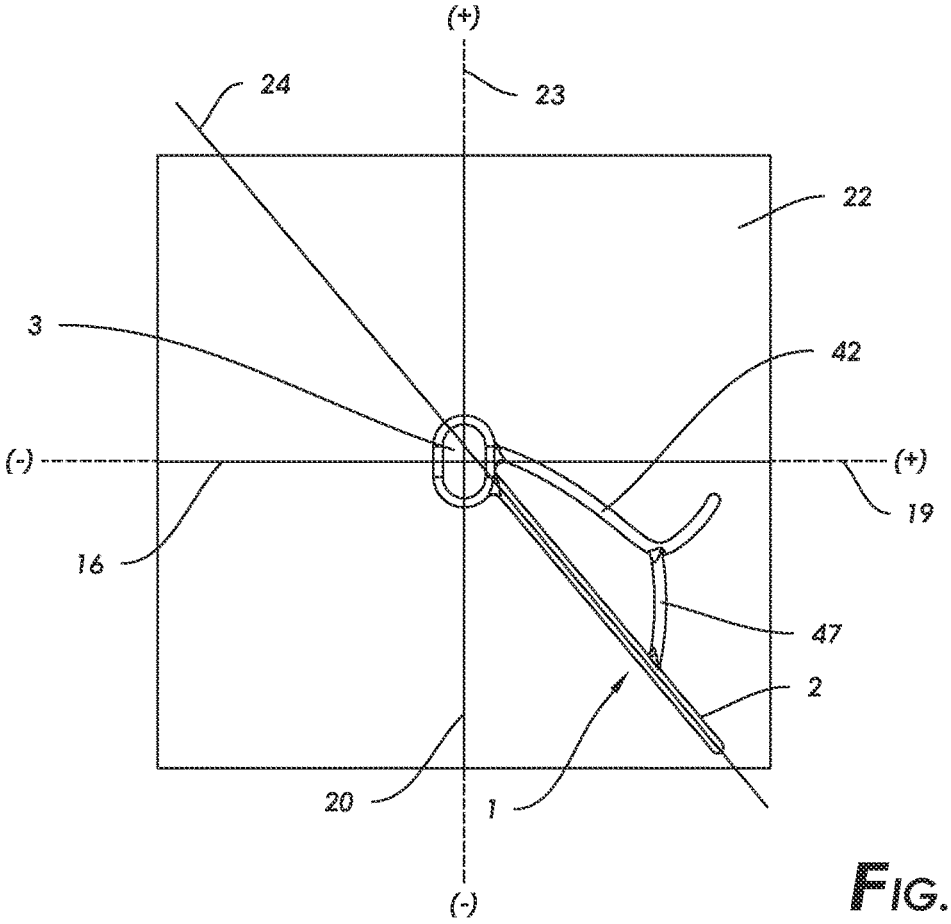

FIG. 3B a second side view or a right side view of the particular embodiment of the spacer shown in FIG. 3A, the view including reference planes and axes.

Figure 4A:
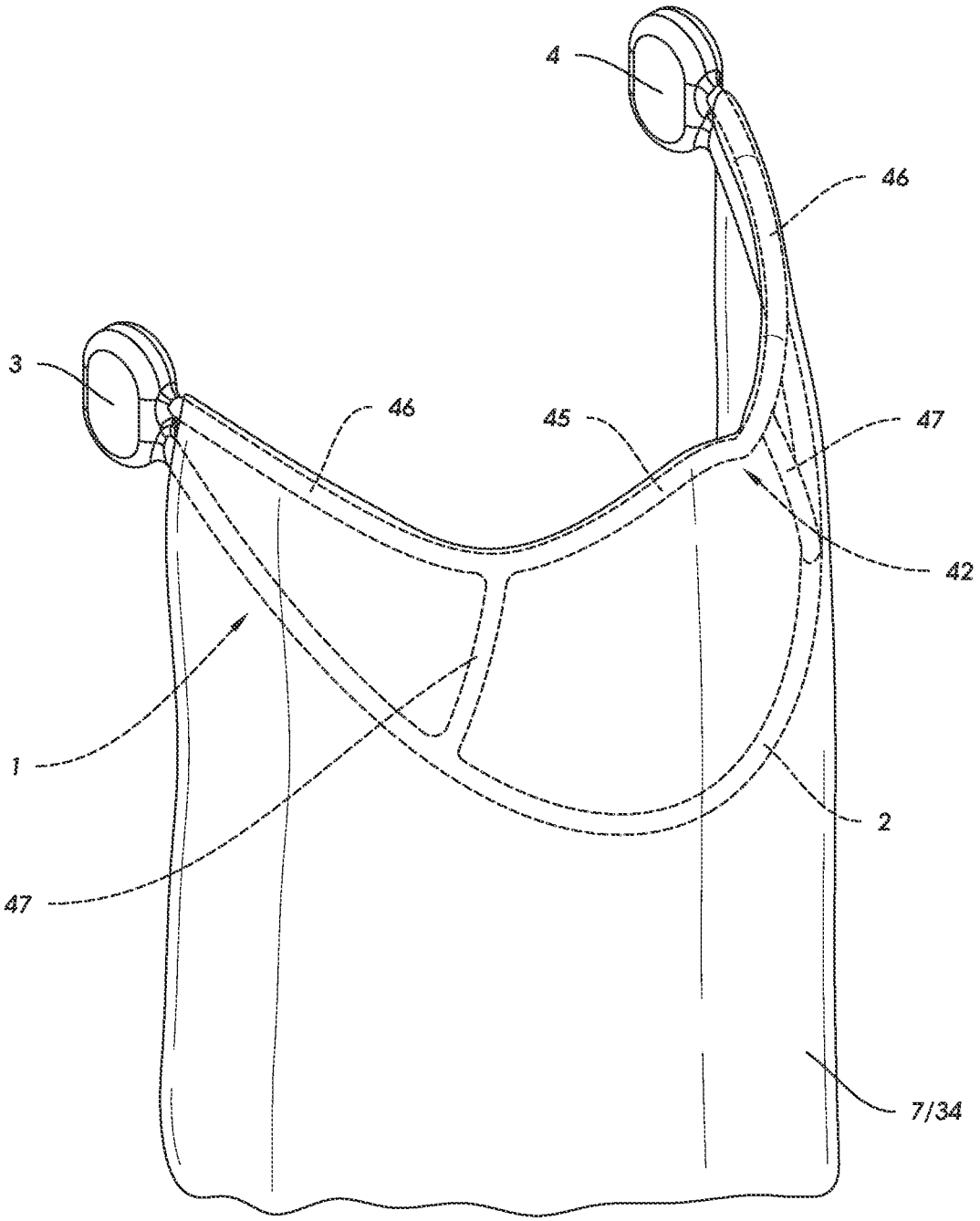

FIG. 4A is a perspective view of a particular embodiment of the inventive spacer with a face covering coupled thereto.

Figure 4C:
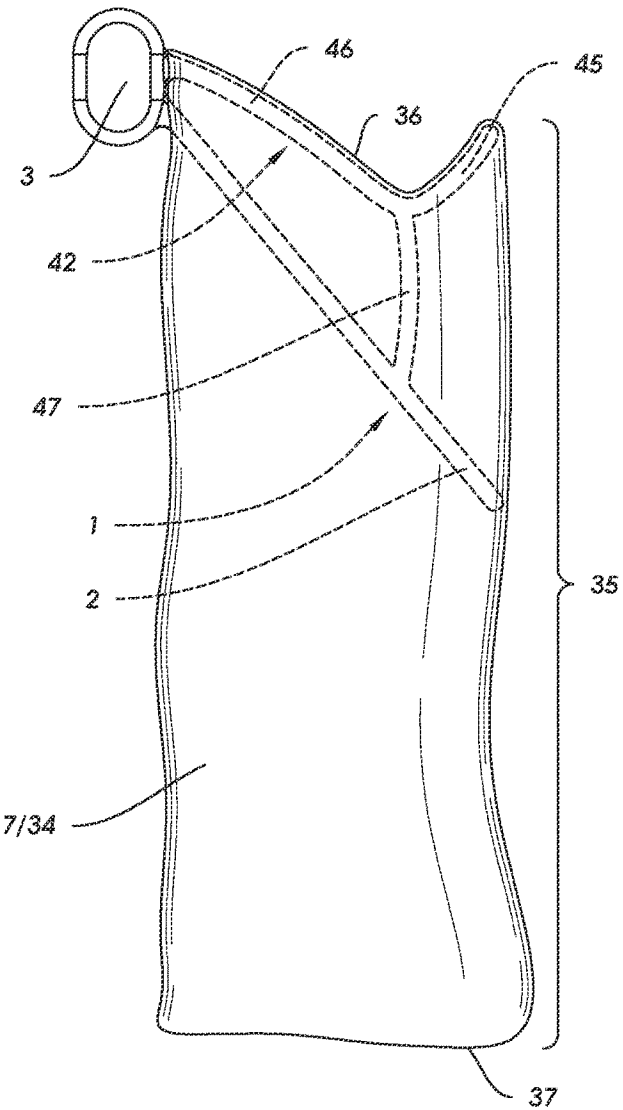
Figure 4B:
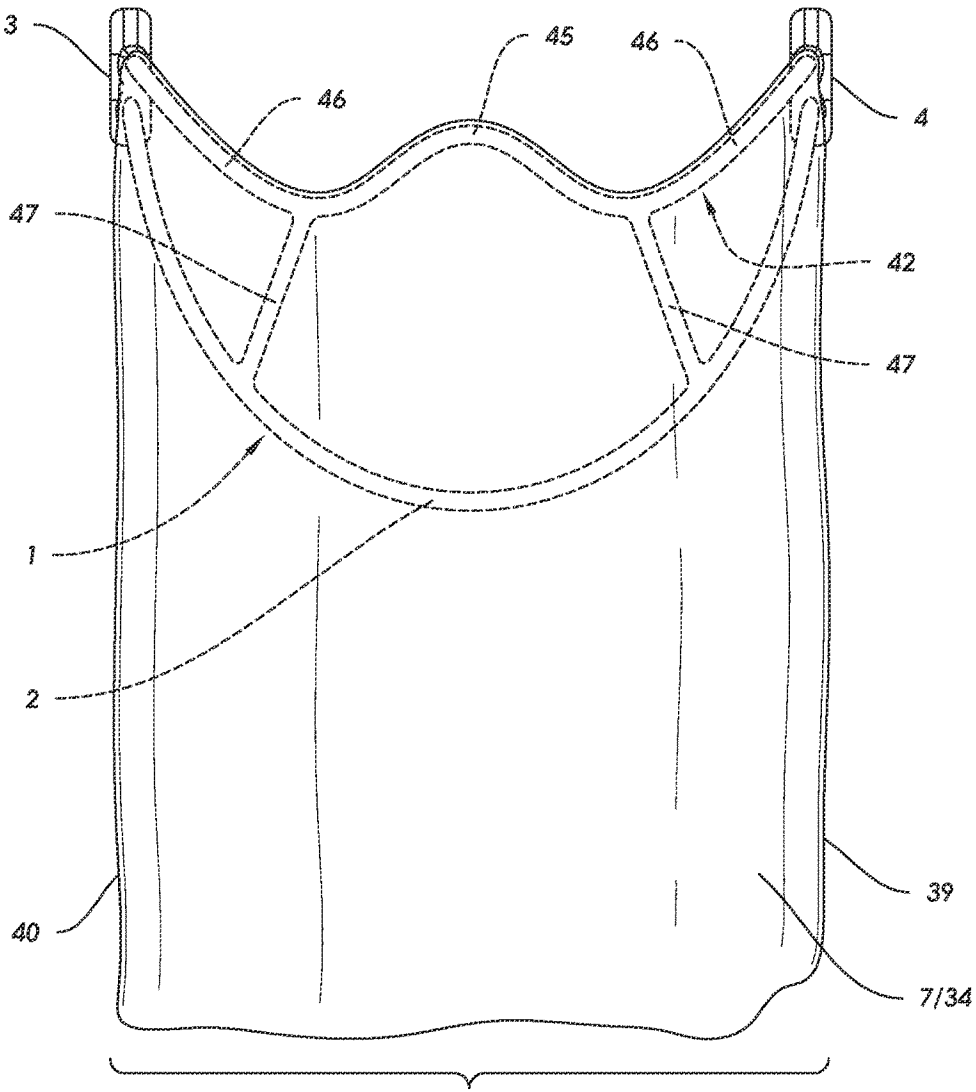

FIG. 4B is a front view of the particular embodiment of the spacer and face covering shown in FIG. 4A.

FIG. 4C is a second side view or a right side view of the particular embodiment of the spacer and face covering shown in FIG. 4A.

Figure 5A:
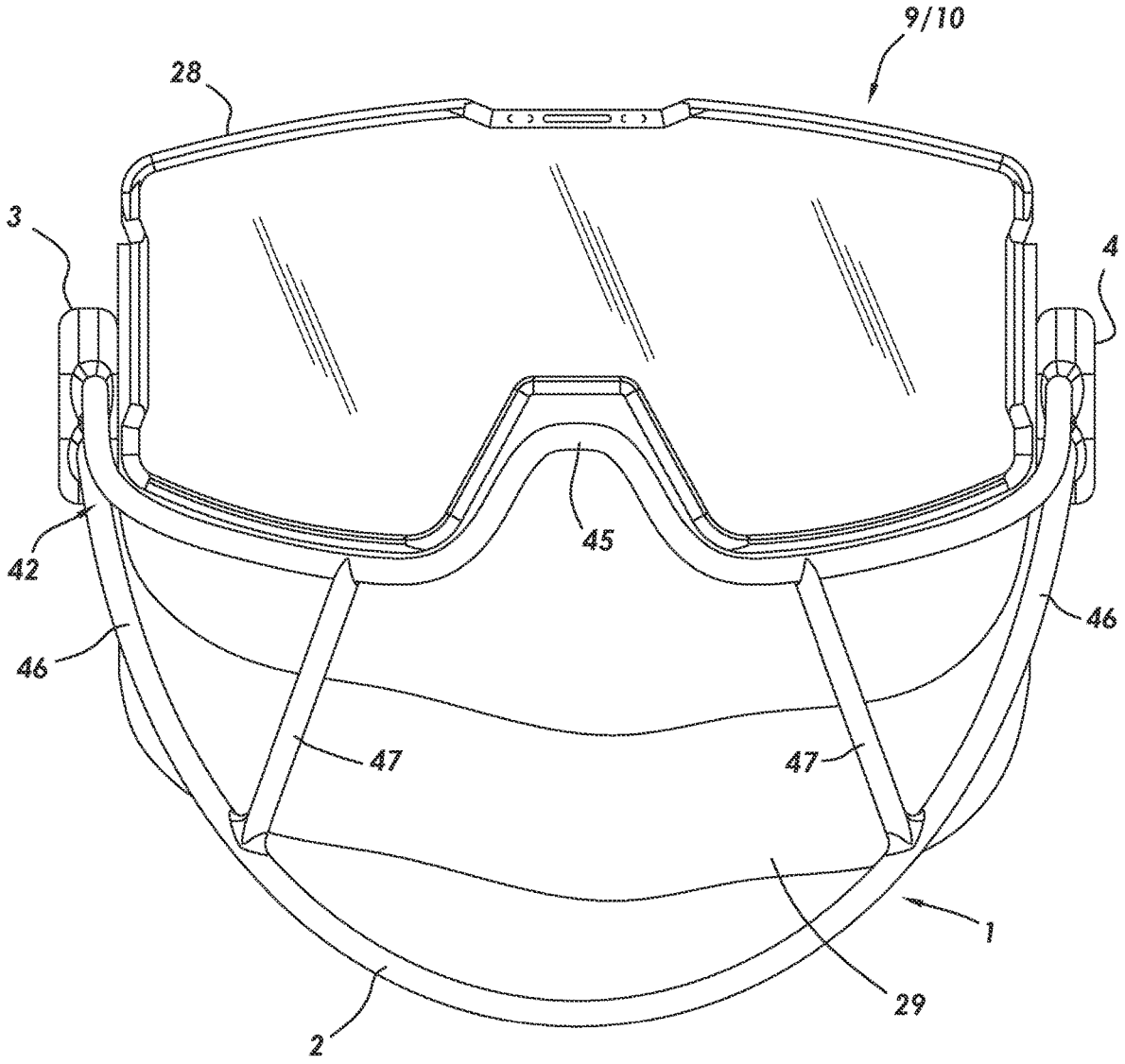

FIG. 5A is a perspective view of a particular embodiment of the inventive spacer coupled to eyewear, and specifically goggles.

Figure 5B:
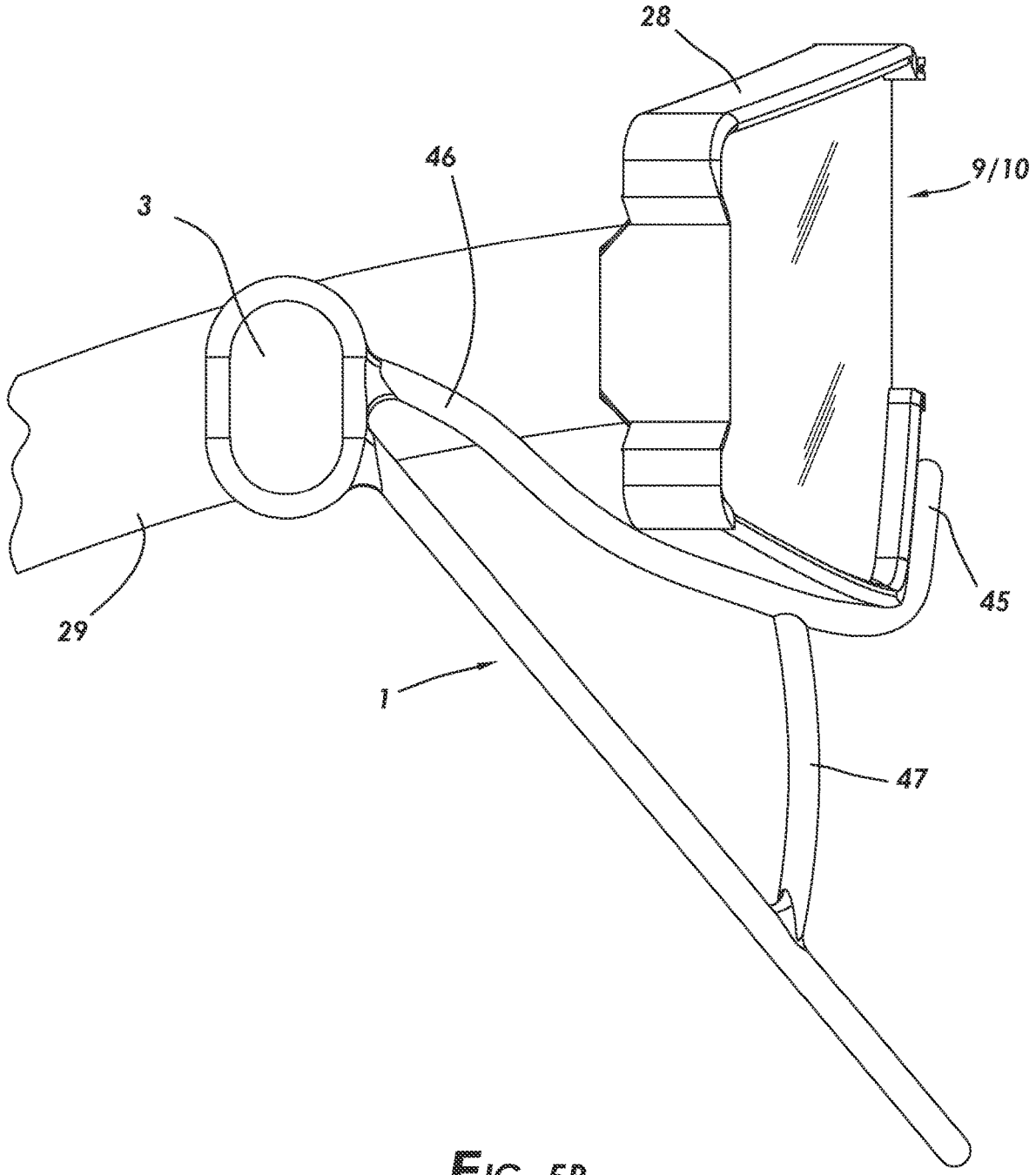

FIG. 5B is a second side view or a right side view of the particular embodiment of the spacer and goggles shown in FIG. 5A.

Figure 6A:
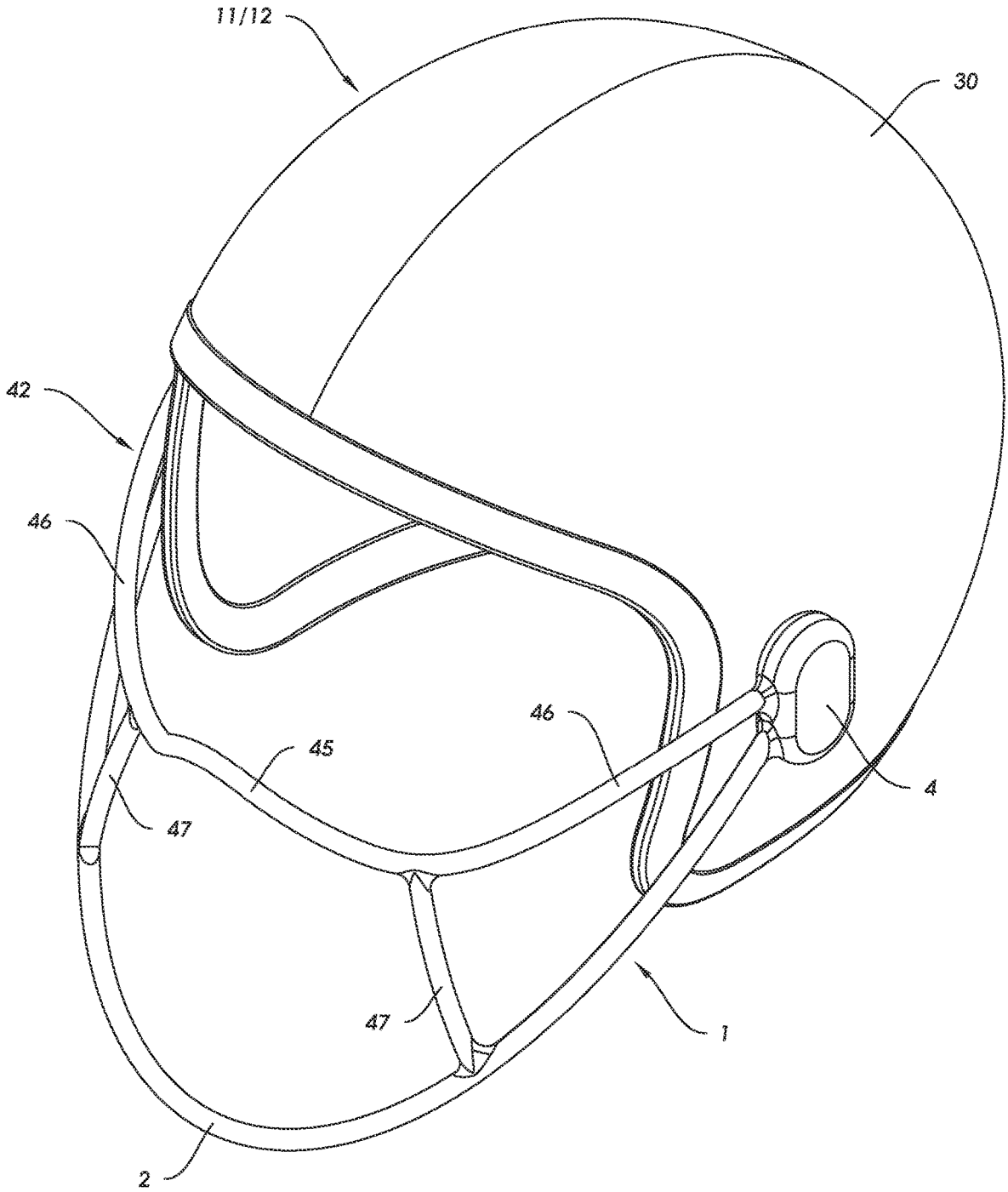

FIG. 6A is a perspective view of a particular embodiment of the inventive spacer coupled to headwear, and specifically a helmet.

Figure 6B:
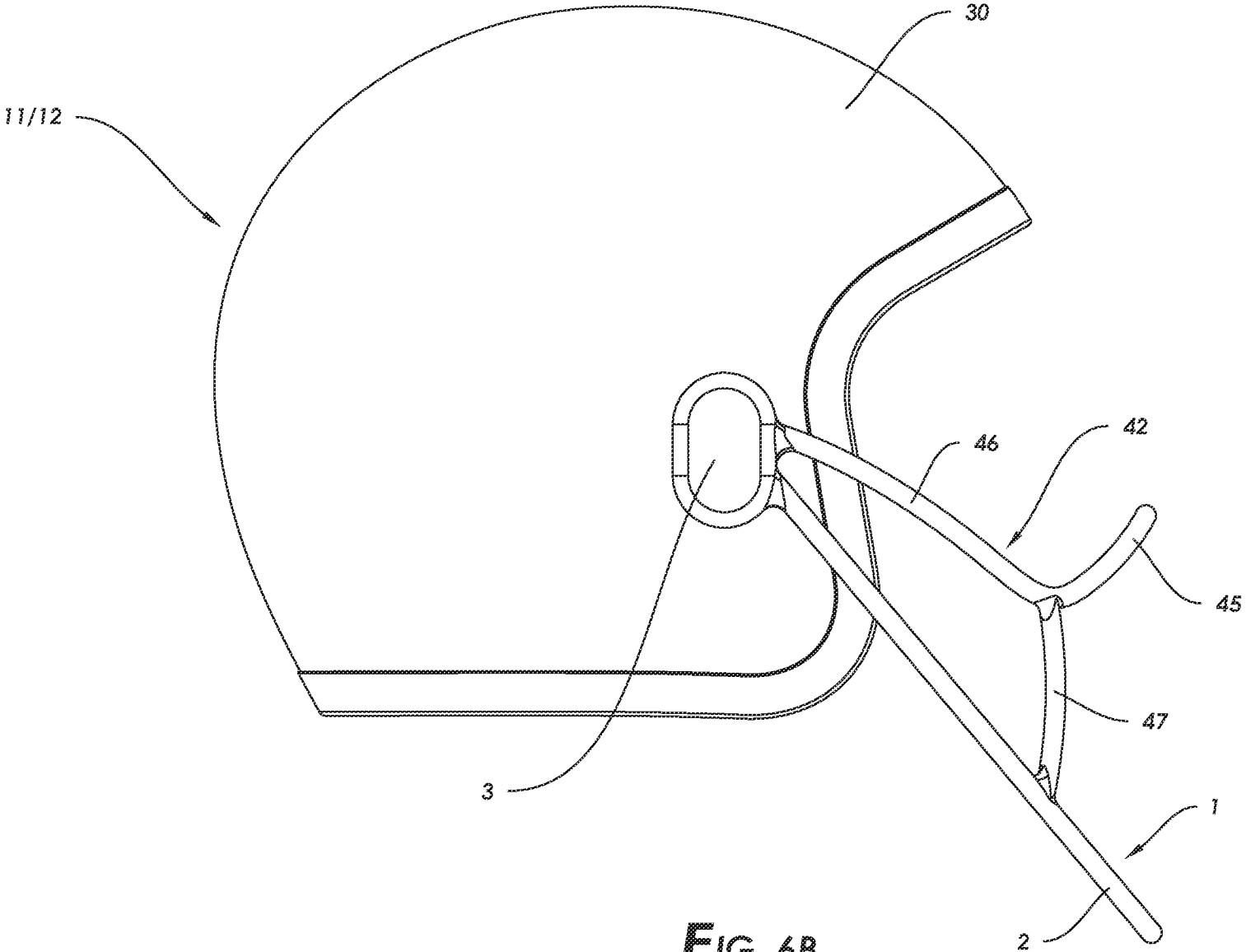

FIG. 6B is a second side view or a right side view of the particular embodiment of the spacer and helmet shown in FIG. 6A.

Figure 7B:
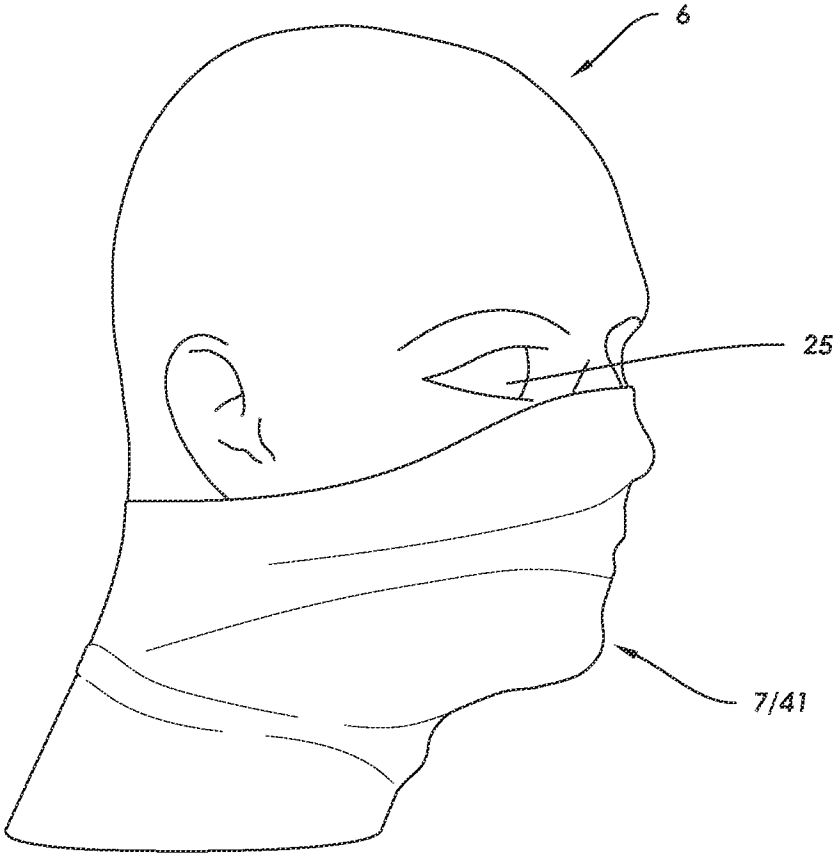
Figure 7A:
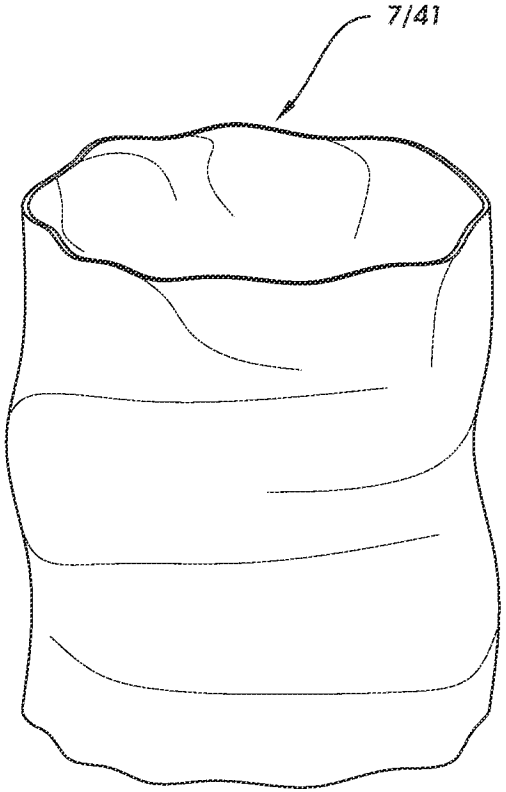

FIG. 7A is a perspective view of a particular embodiment of a face covering configured as fabric sleeve which may be used with the inventive spacer.

FIG. 7B is a perspective view of the particular embodiment of the fabric sleeve shown in FIG. 7A when worn by a wearer without the inventive spacer.

Figure 7C:
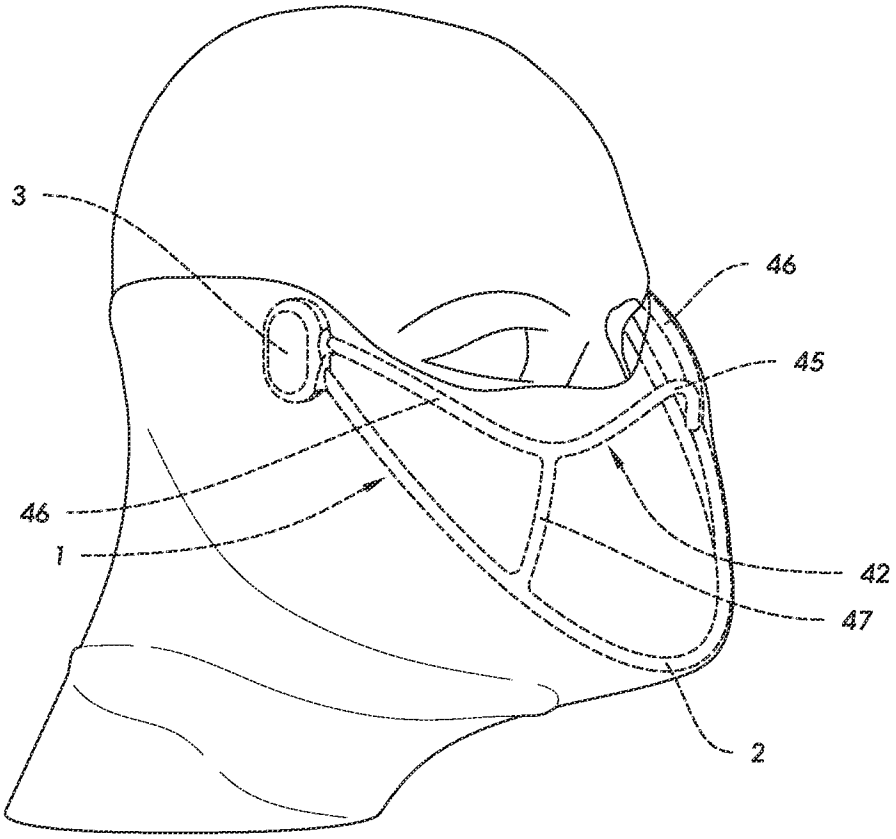

FIG. 7C is a perspective view of the particular embodiment of the fabric sleeve shown in FIG. 7A when worn by a wearer with the inventive spacer.

Figure 8A:
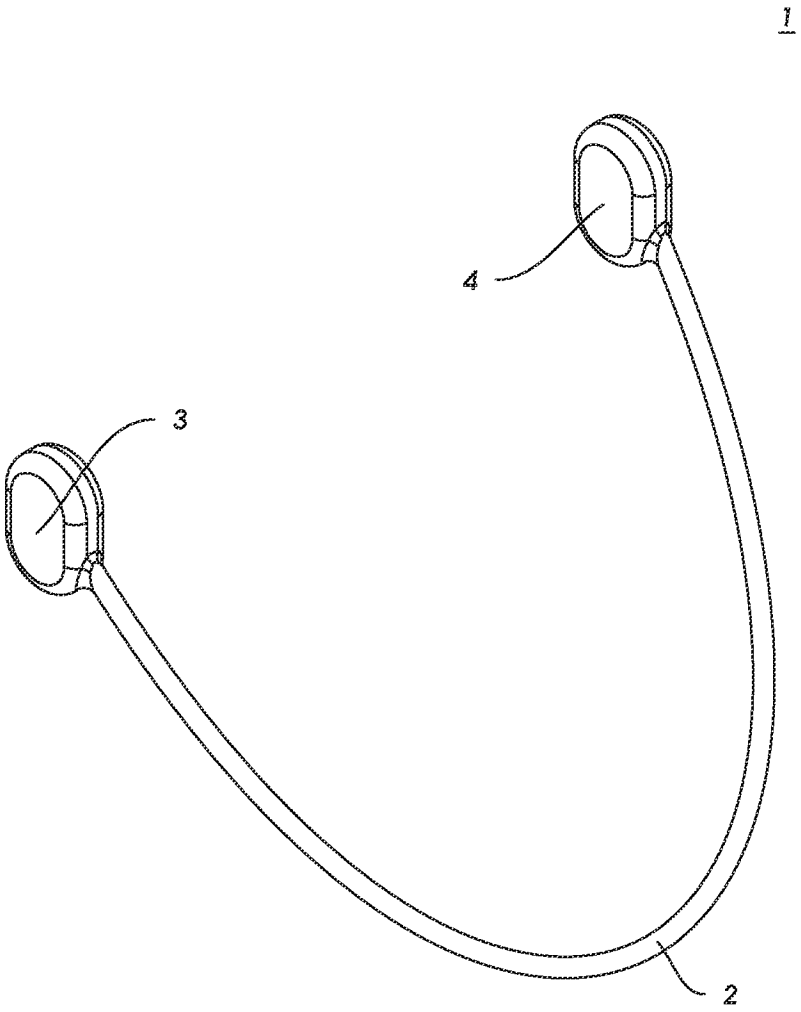

FIG. 8A is a perspective view of a particular embodiment of the inventive spacer.

Figure 8B:
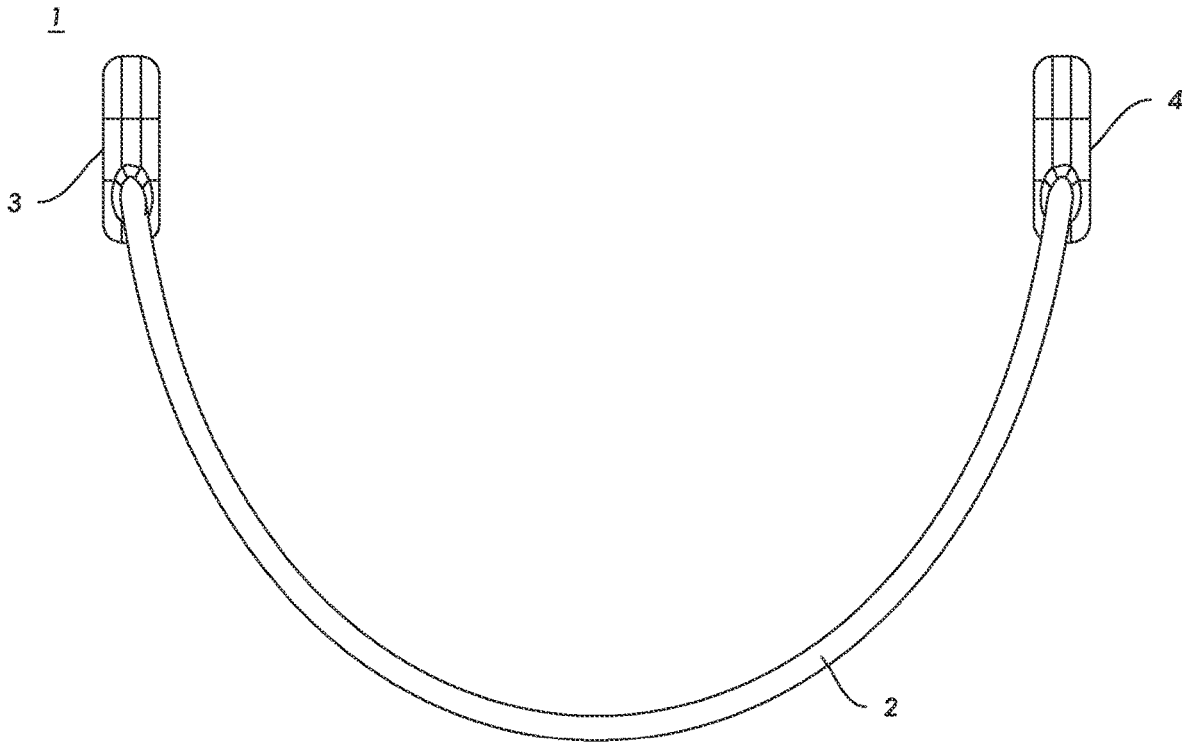

FIG. 8B is a front view of the particular embodiment of the spacer shown in FIG. 8A.

Figure 8C:
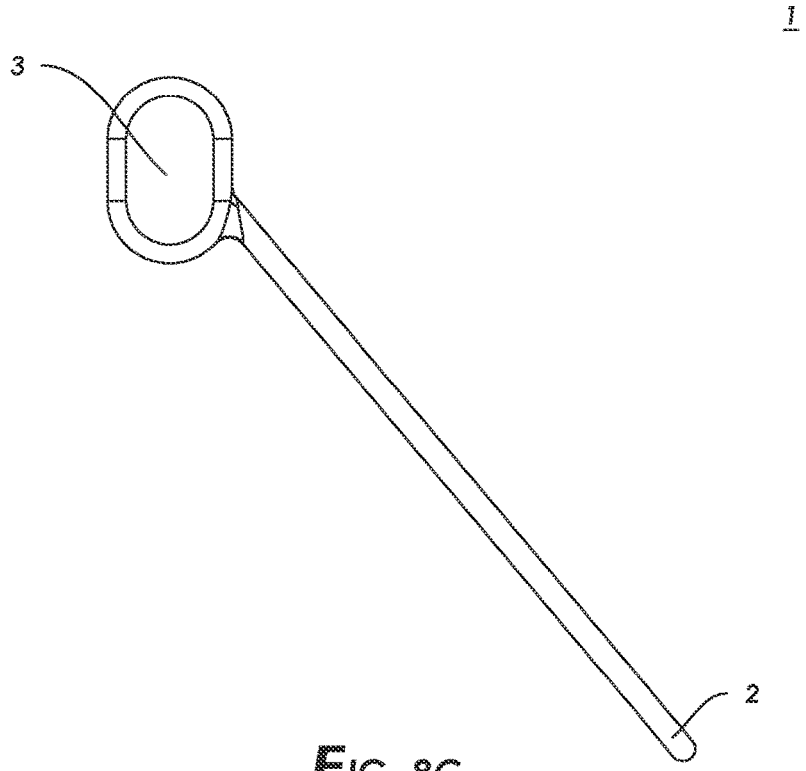

FIG. 8C is a second side view or a right side view of the particular embodiment of the spacer shown in FIG. 8A.

Figure 9A:
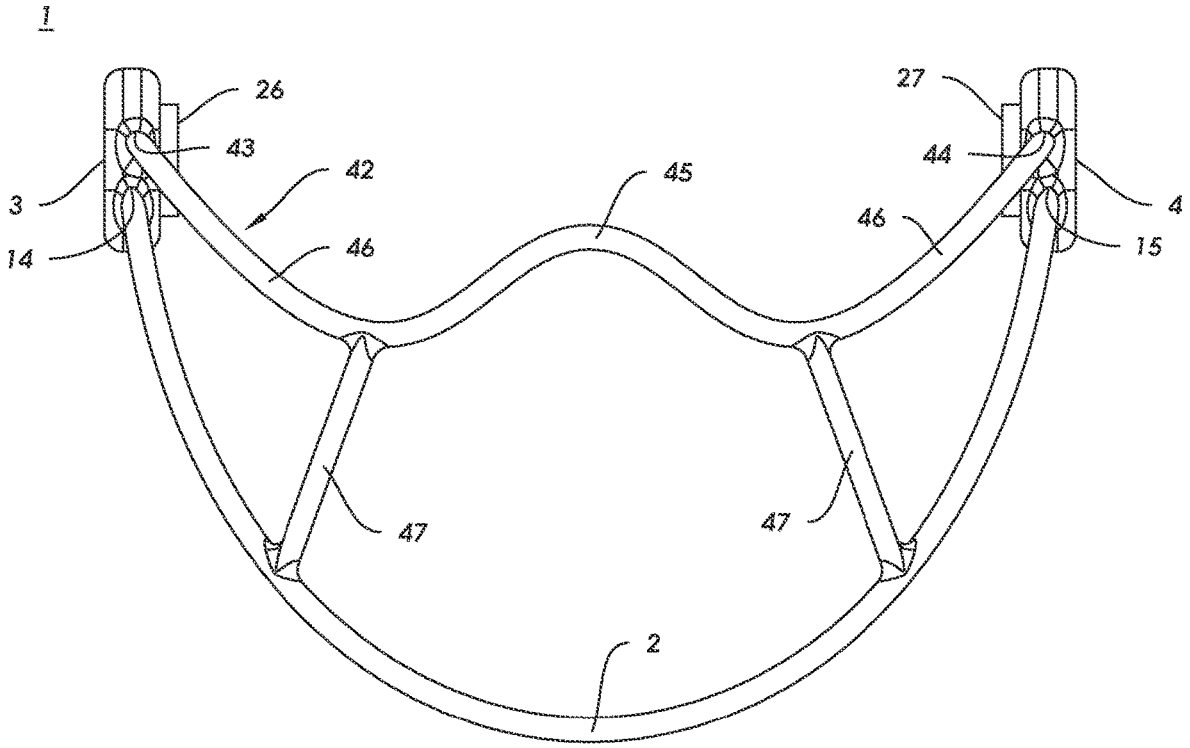

FIG. 9A is a front view of a particular embodiment of the inventive spacer including attachment elements coupled to attachment points.

Figure 9B:
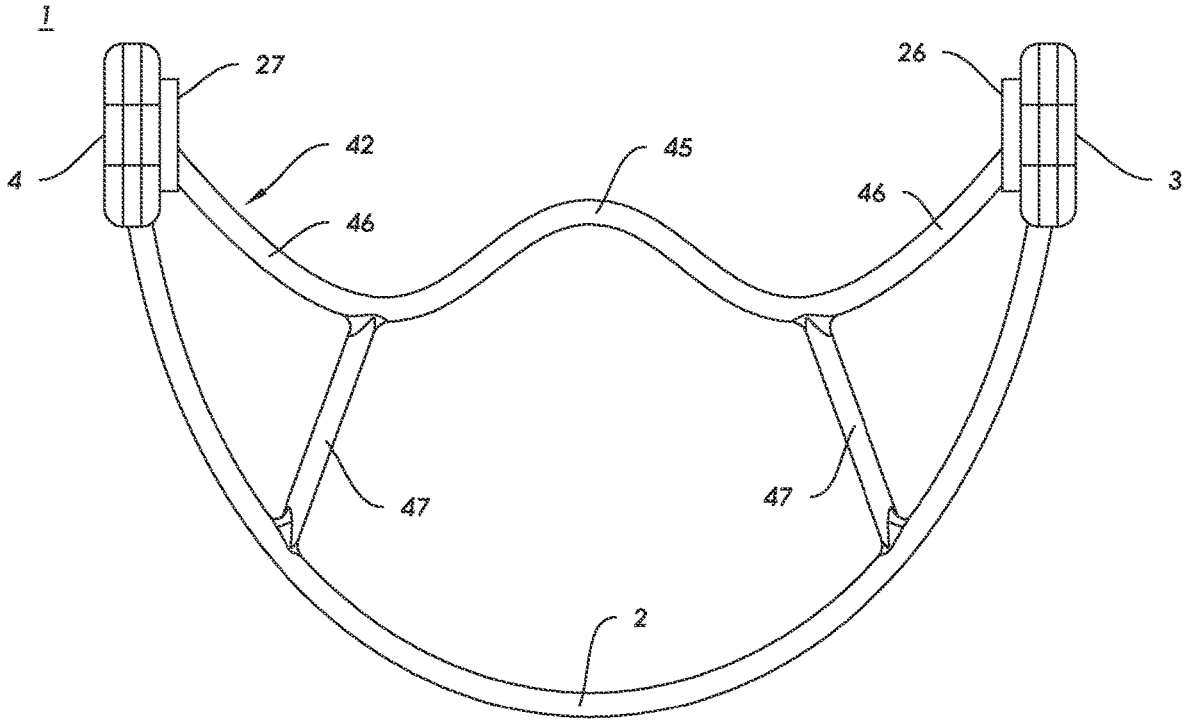

FIG. 9B is a rear view of the particular embodiment of the spacer shown in FIG. 9A.

Figure 9C:
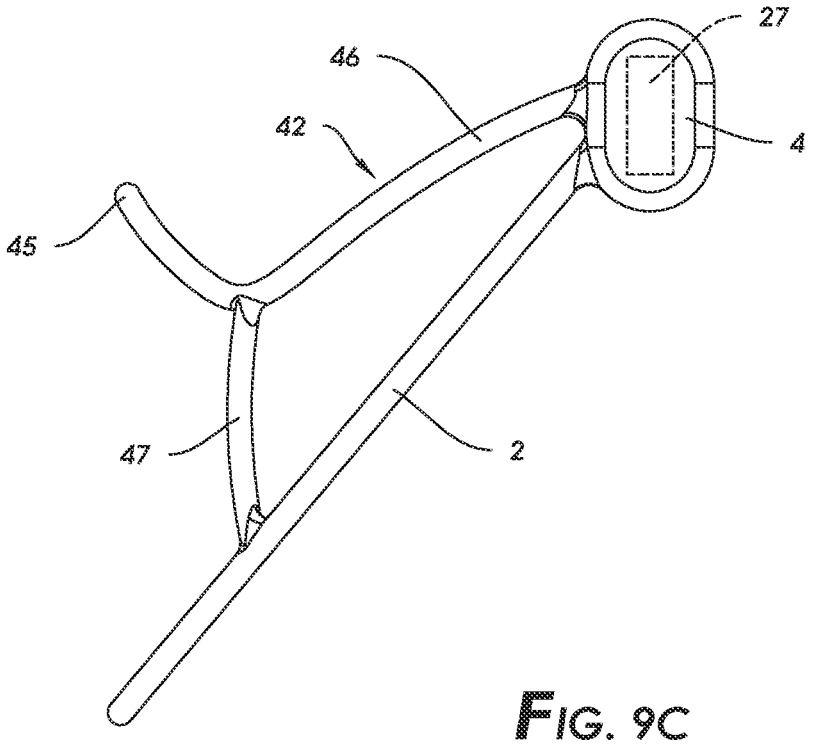

FIG. 9C is a first side view or a left side view of the particular embodiment of the spacer shown in FIG. 9A.

Figure 9D:
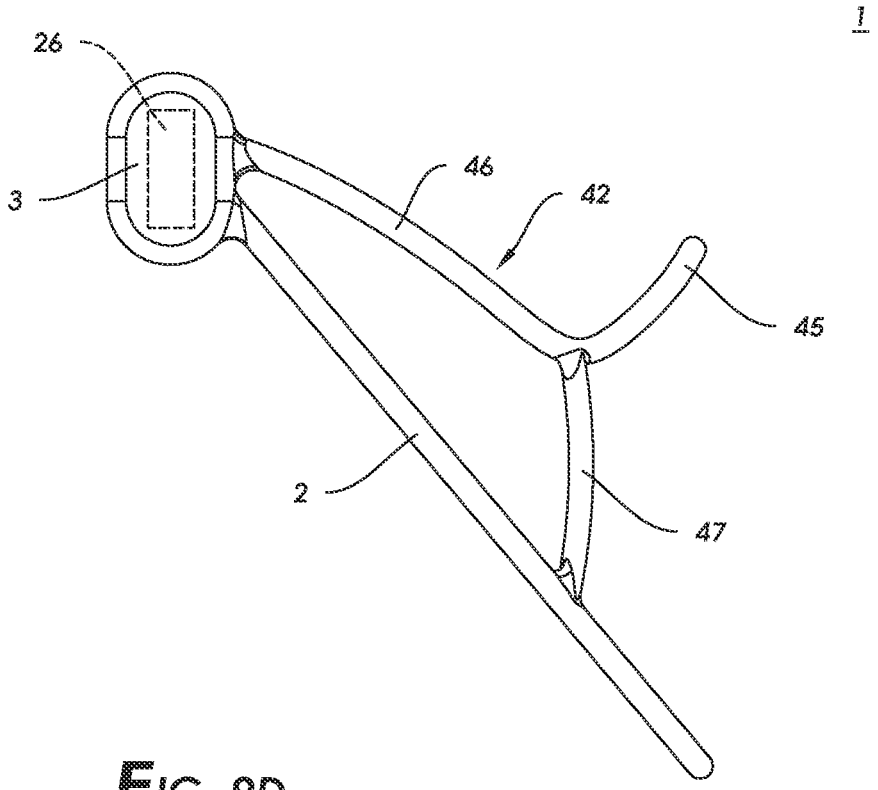

FIG. 9D is a second side view or a right side view of the particular embodiment of the spacer shown in FIG. 9A.

Figure 10A:
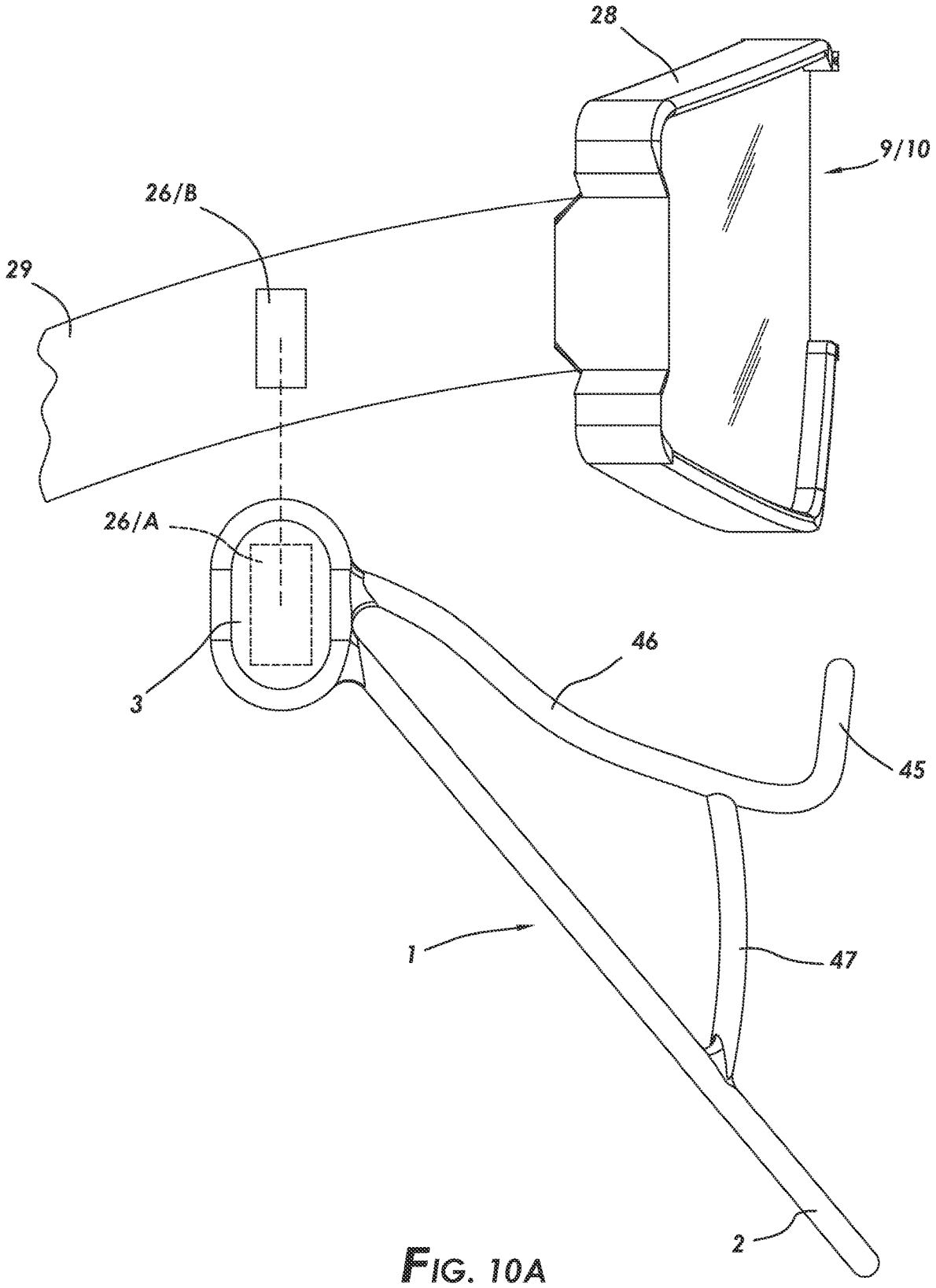

FIG. 10A is a second side view or a right side view of a particular embodiment of the inventive spacer exploded from eyewear, and specifically goggles.

Figure 10B:
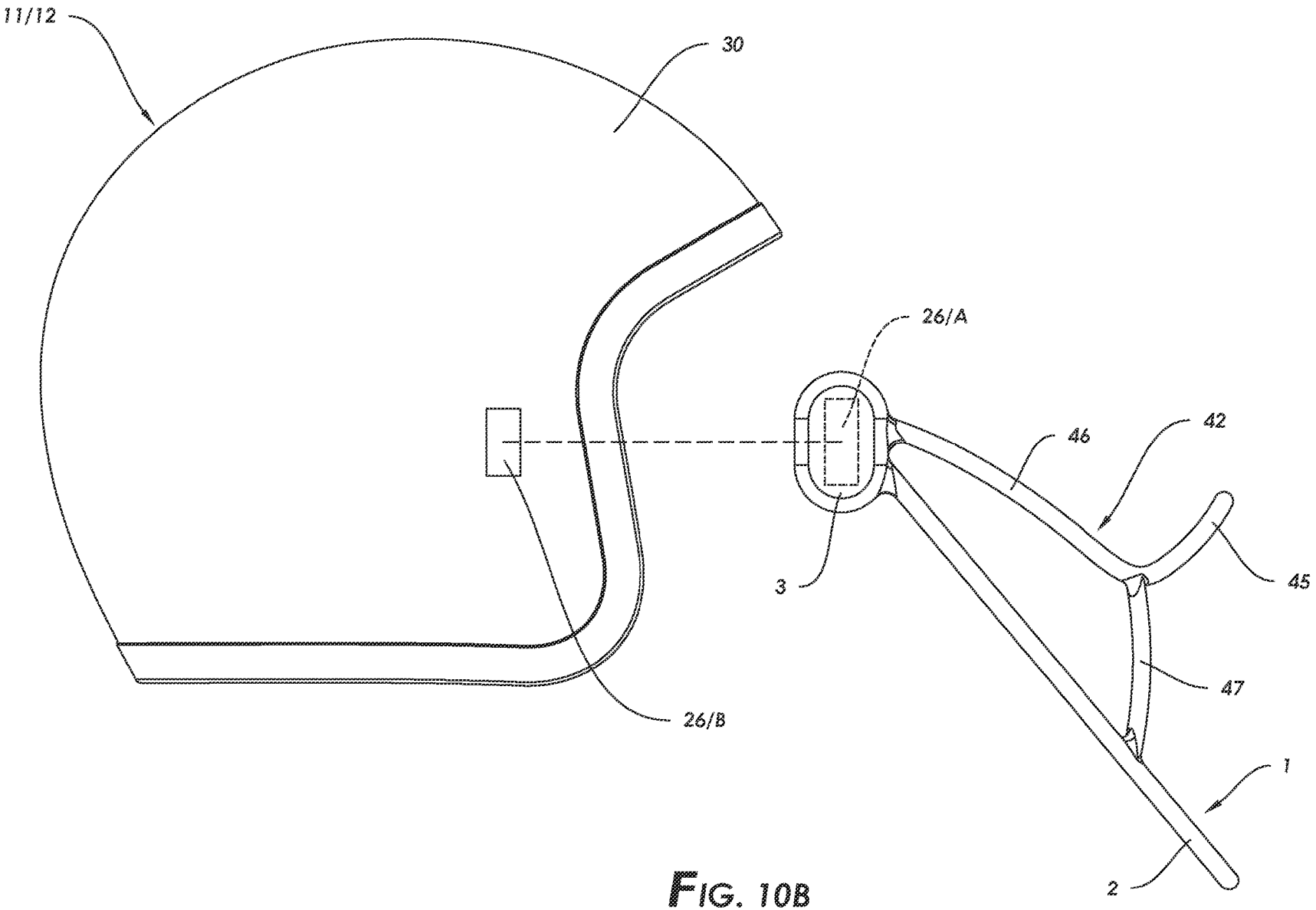

FIG. 10B is a second side view or a right side view of a particular embodiment of the inventive spacer exploded from headwear, and specifically a helmet.

Figure 11B:
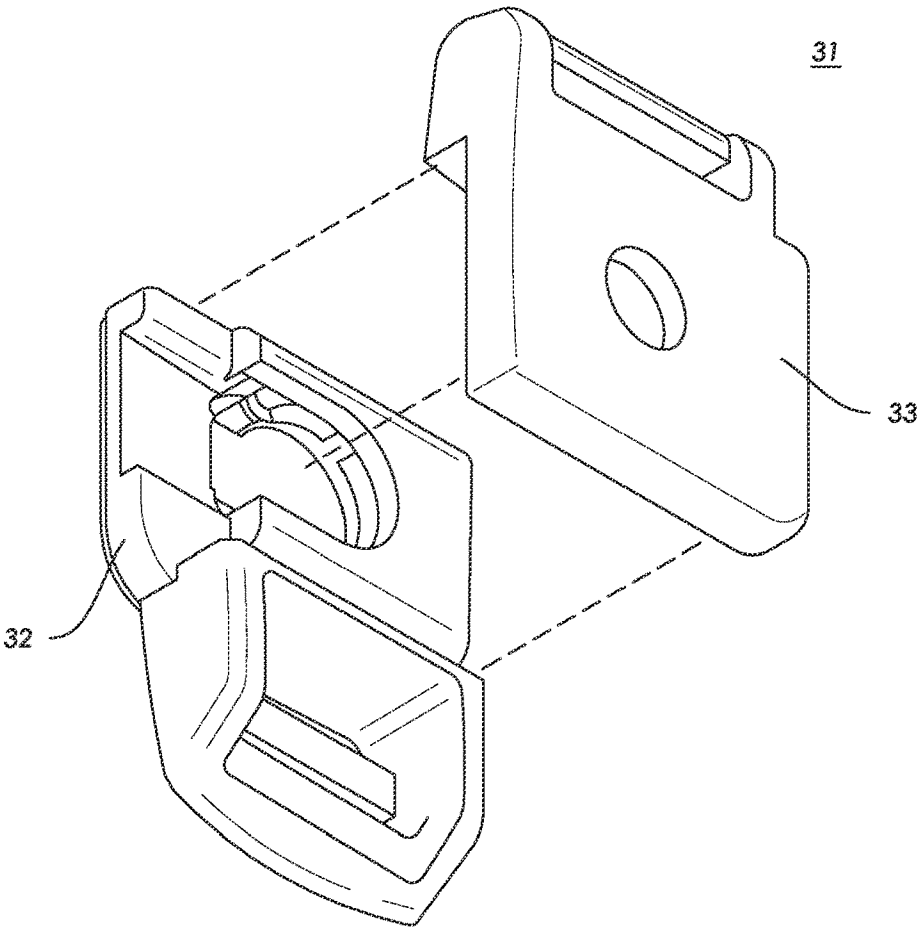
Figure 11A:
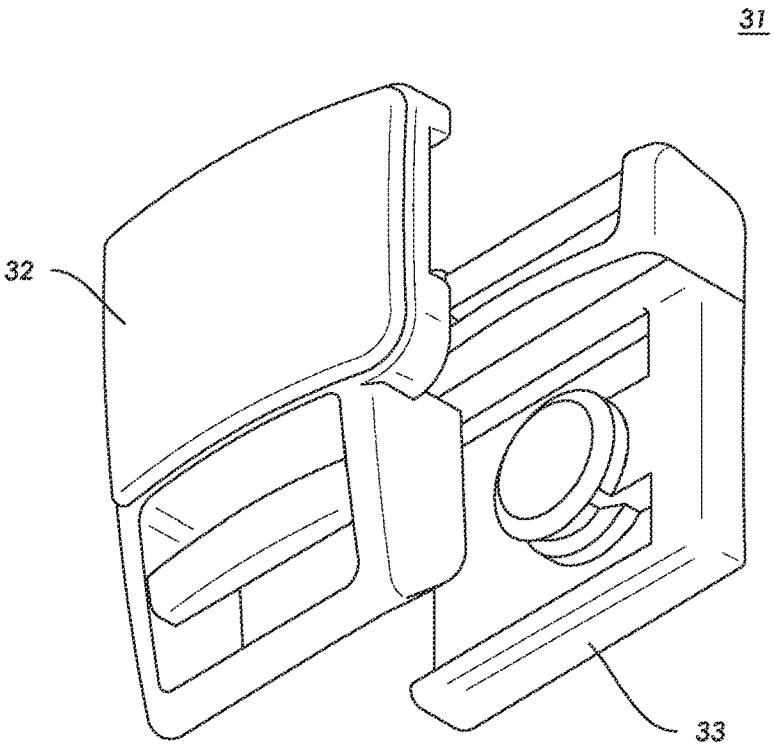

FIG. 11A is a first perspective view of a particular embodiment of components of a mechanical-magnetic connecting structure which may be useful to releasably couple the inventive spacer to eyewear or headwear.

FIG. 11B is a second perspective view of the particular embodiment of the components of the mechanical-magnetic connecting structure shown in FIG. 11A.

Figure 11D:
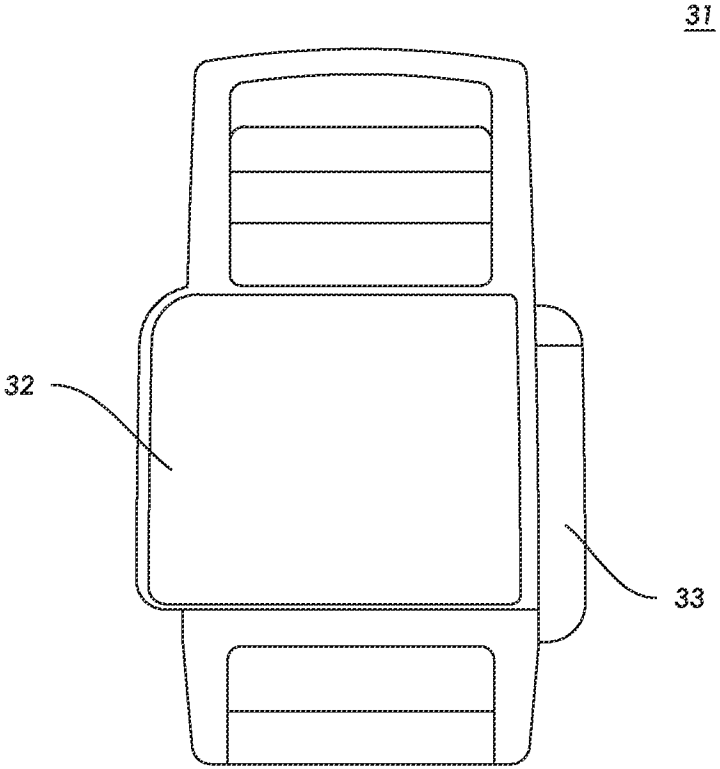
Figure 11C:
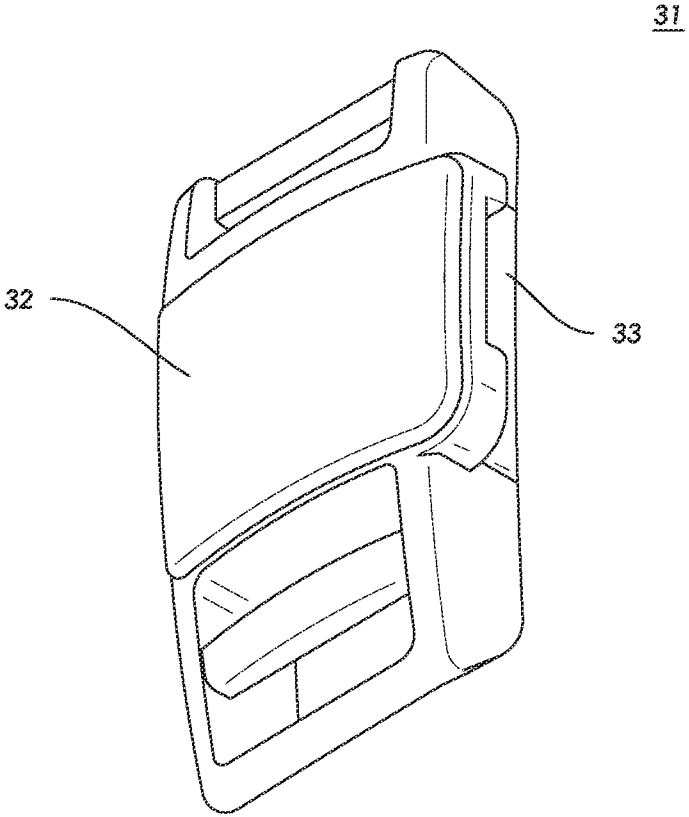

FIG. 11C is a perspective view of the mechanical-magnetic connecting structure shown in FIG. 11A in a closed position.

FIG. 11D is a top view of the mechanical-magnetic connecting structure shown in FIG. 11A in a closed position.

Figure 11F:
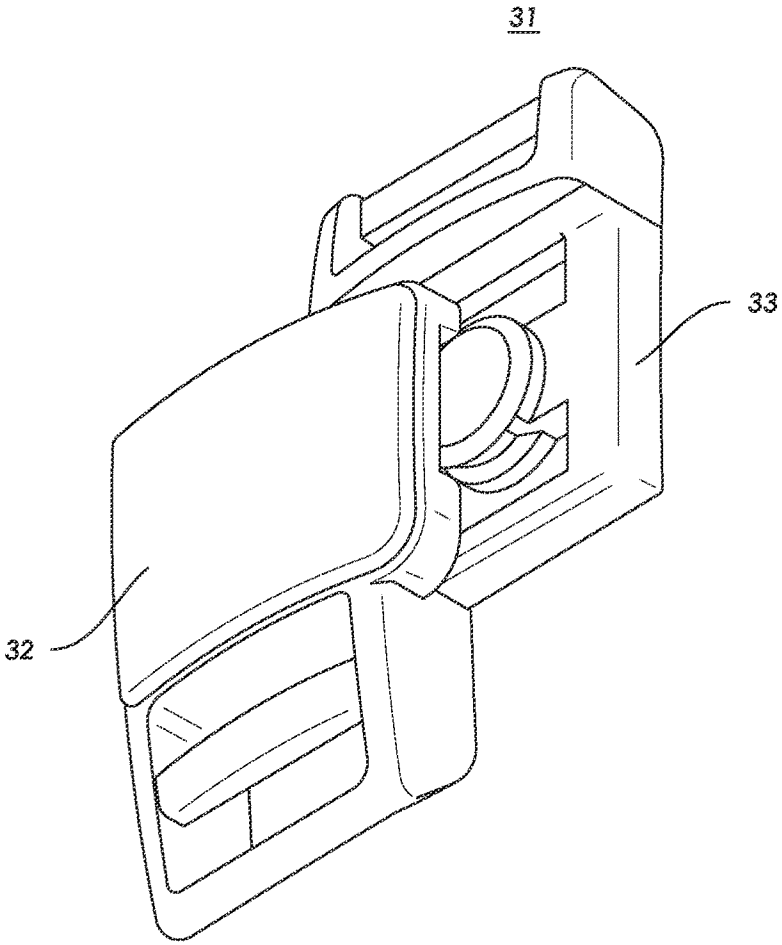
Figure 11E:
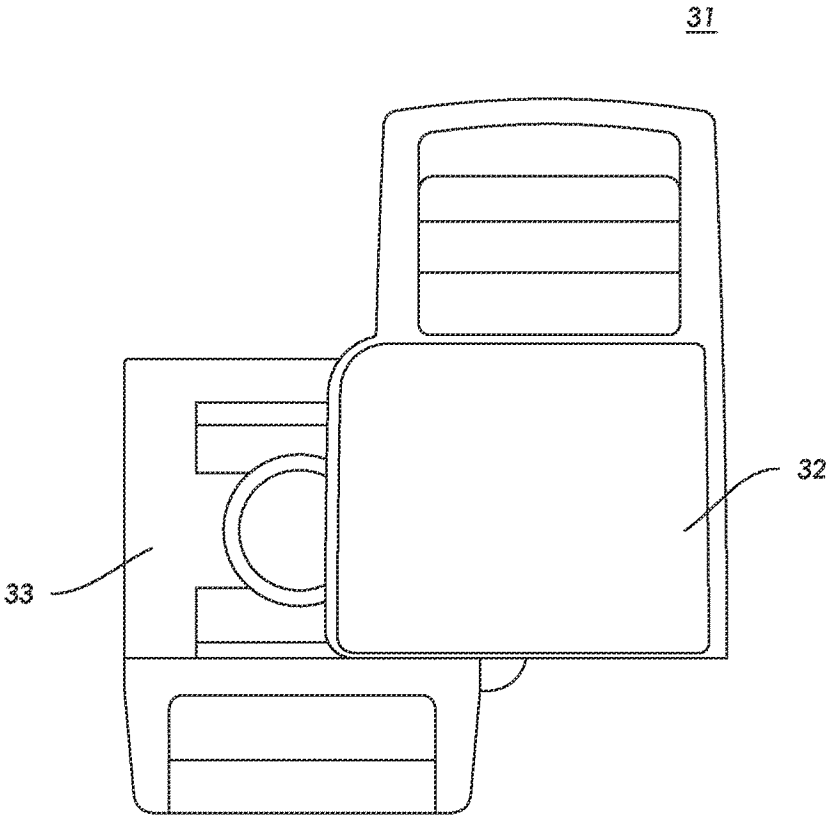

FIG. 11E is a perspective view of the mechanical-magnetic connecting structure shown in FIG. 11A in an opened state.

FIG. 11F is a top view of the mechanical-magnetic connecting structure shown in FIG. 11A in an opened state.

III. DETAILED DESCRIPTION OF THE PREFERRED EMBODIMENTS

Figure 1A:
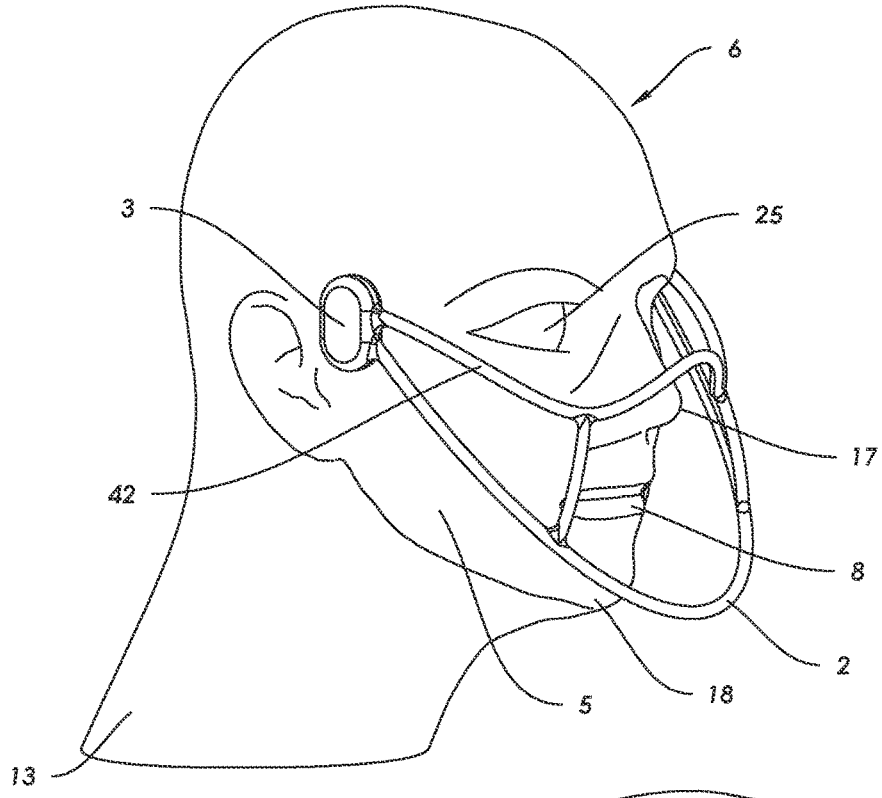
FIG. 1A is an illustration of a particular embodiment of the inventive spacer relative to a wearer.
Figure 1B:
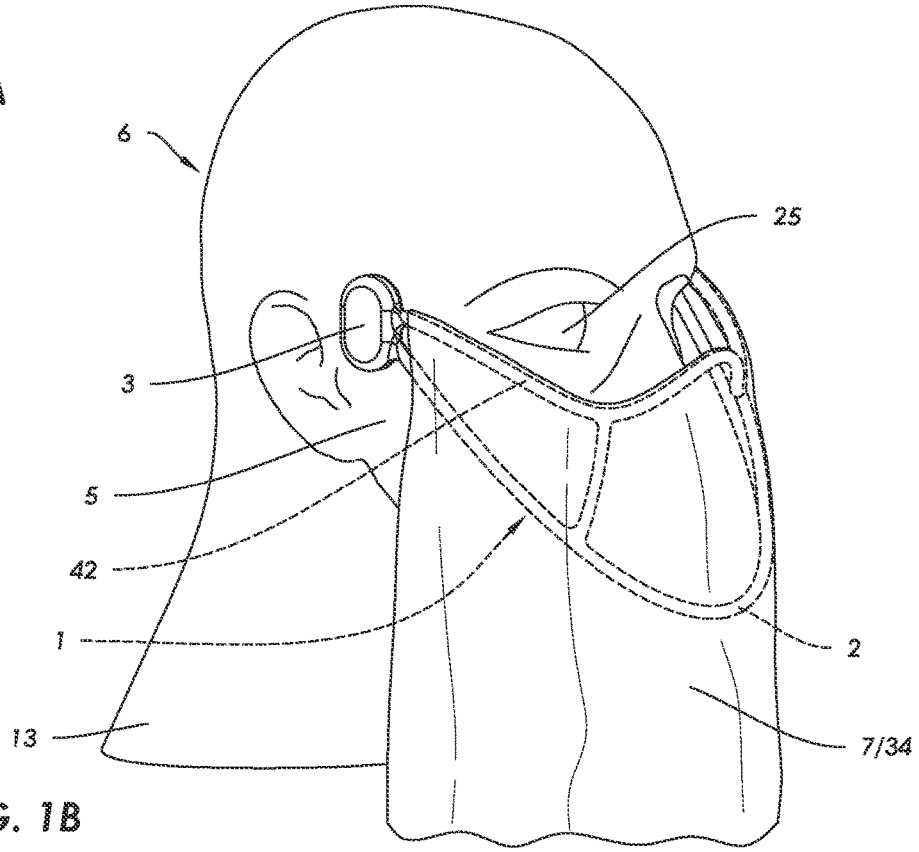
FIG. 1B is an illustration of the particular embodiment of the spacer shown in FIG. 1A, whereby a face covering is coupled to the spacer and correspondingly spaced a distance from the mouth of the wearer.
Figure 2A:
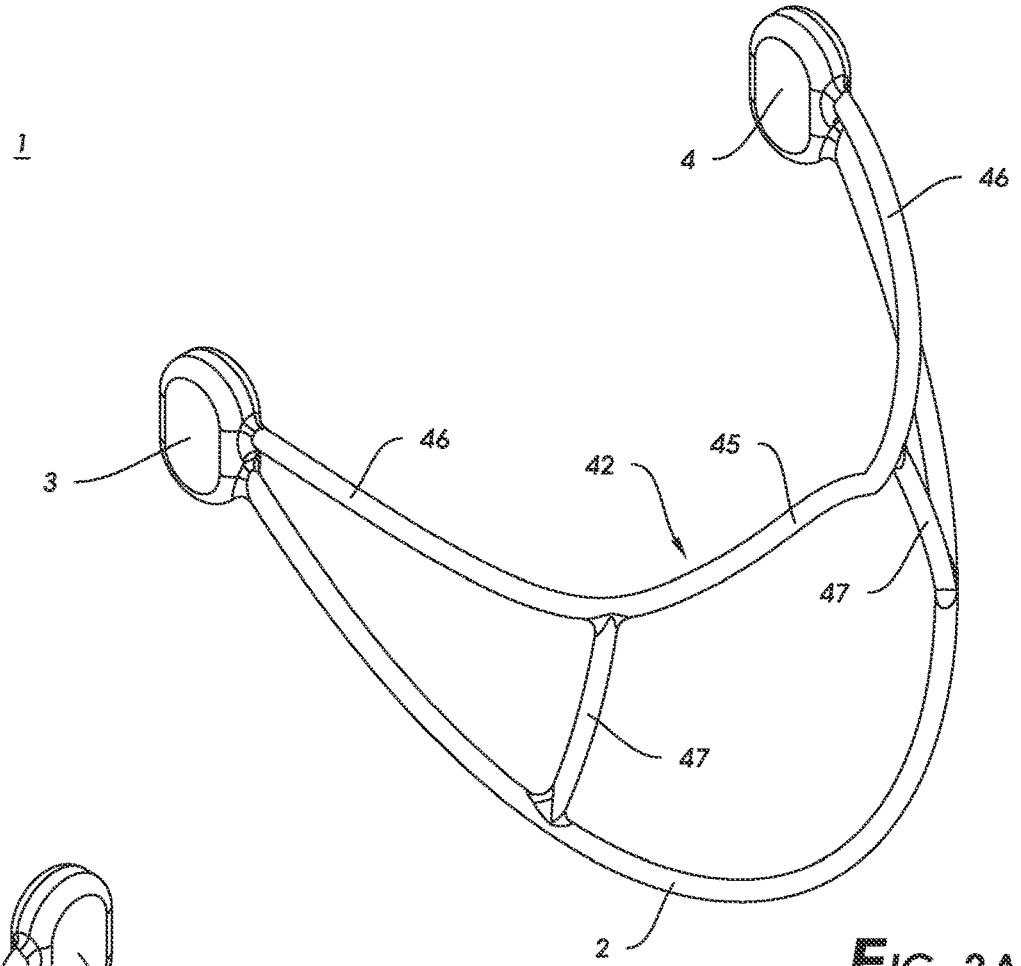
FIG. 2A is a first perspective view of a particular embodiment of the inventive spacer.
Figure 2B:
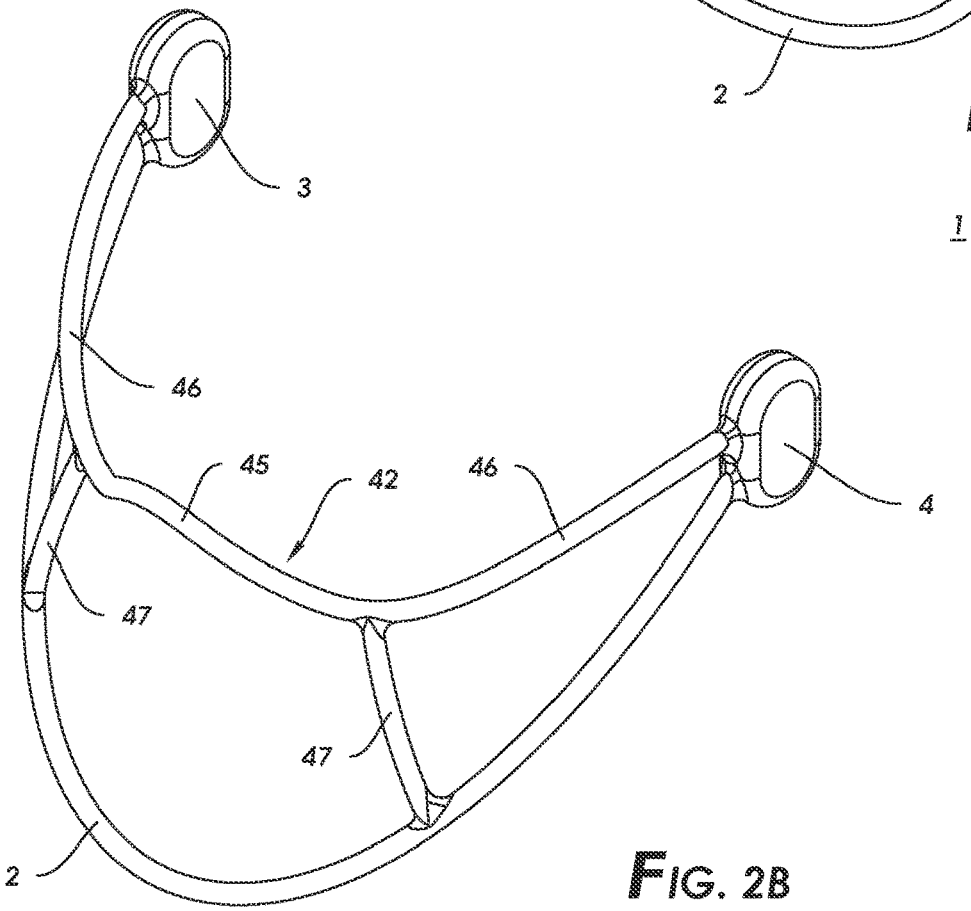
FIG. 2B is a second perspective view of the particular embodiment of the spacer shown in FIG. 2A.
Figure 2C:
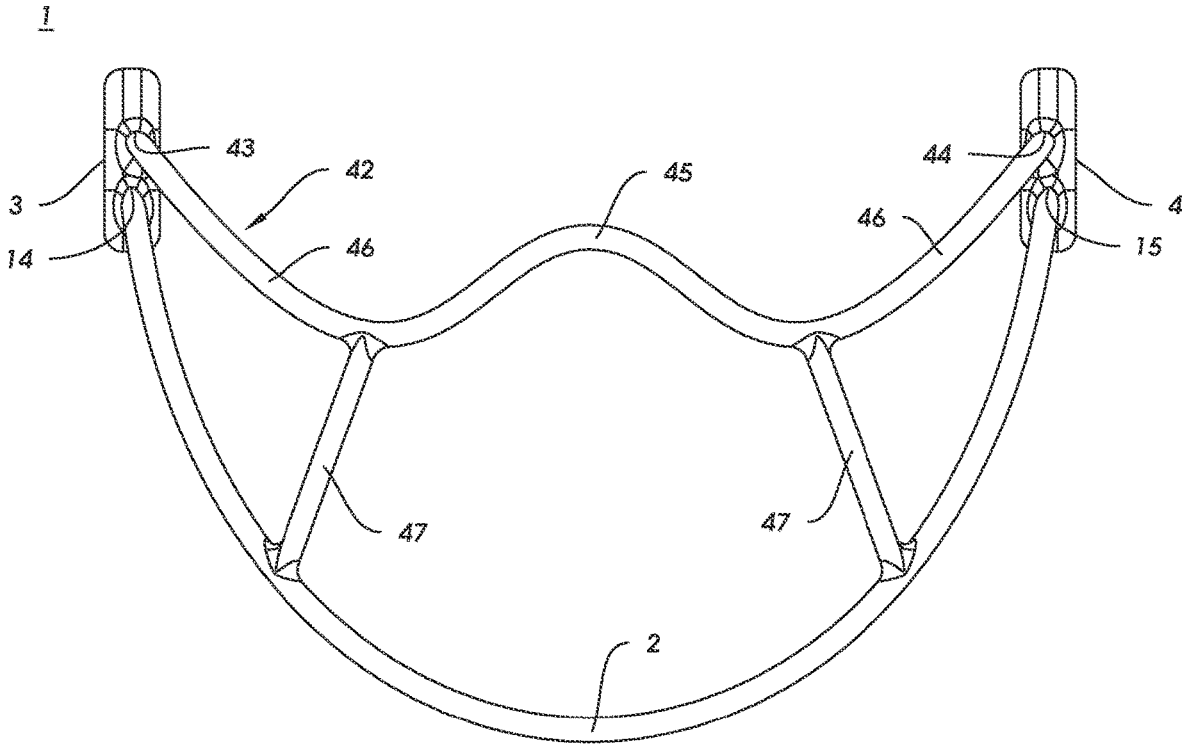
FIG. 2C is a front view of the particular embodiment of the spacer shown in FIG. 2A.
Figure 2D:
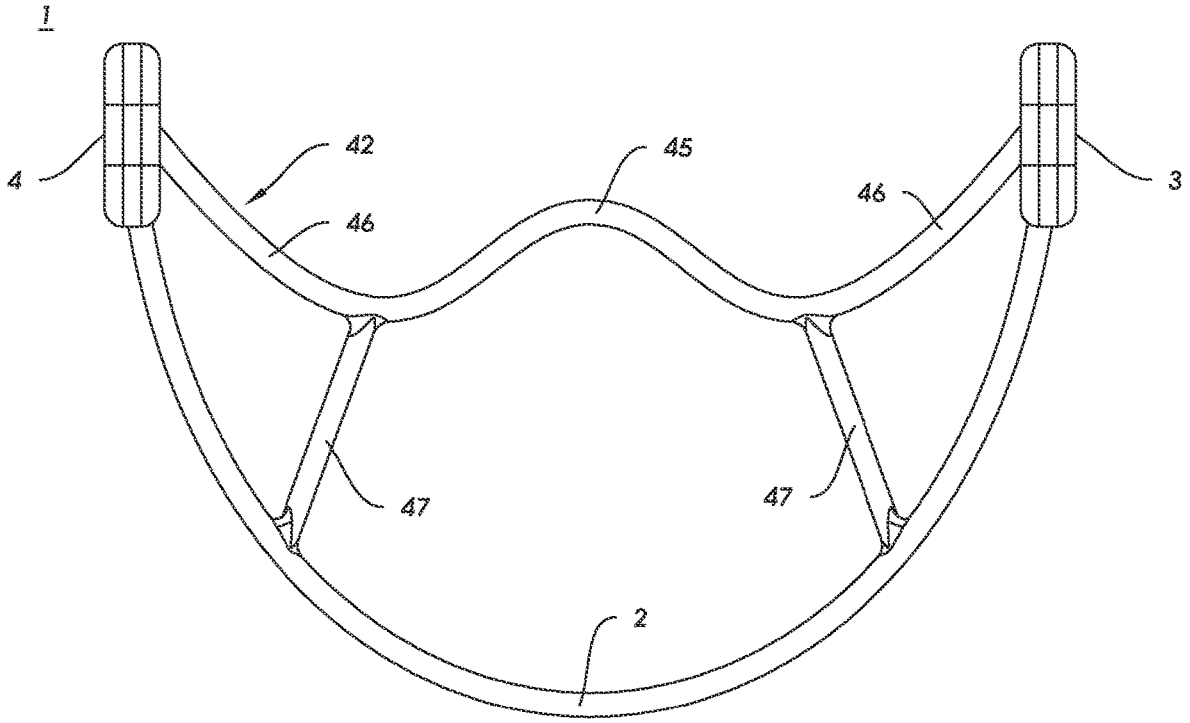
FIG. 2D is a rear view of the particular embodiment of the spacer shown in FIG. 2A.
Figure 2E:
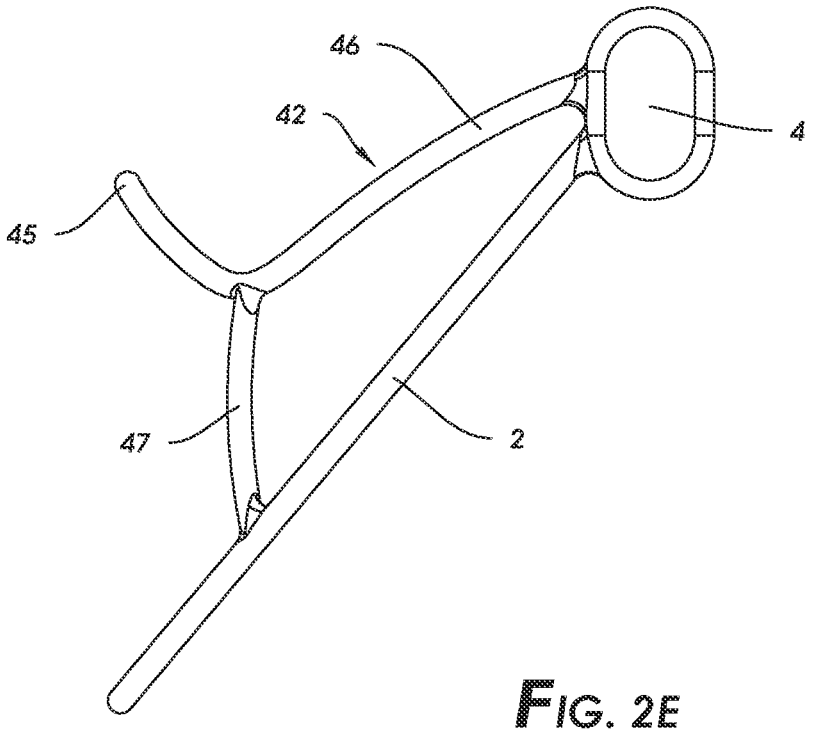
FIG. 2E is a first side view or a left side view of the particular embodiment of the spacer shown in FIG. 2A.
Figure 2F:
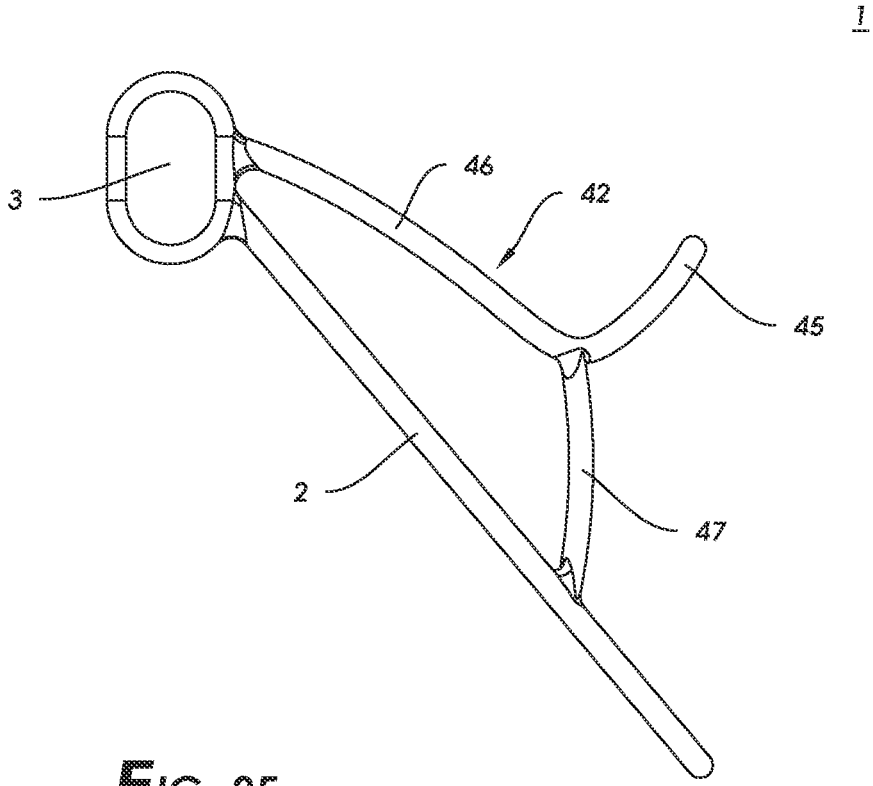
FIG. 2F is a second side view or a right side view of the particular embodiment of the spacer shown in FIG. 2A.
Figure 2G:
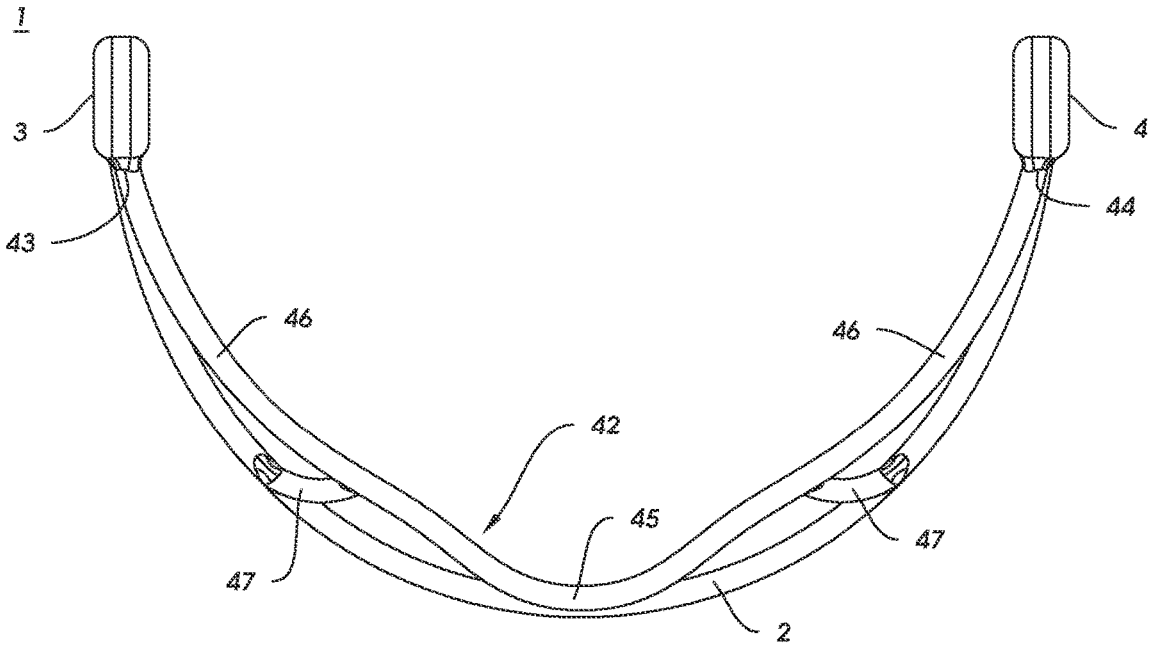
FIG. 2G is a top view of the particular embodiment of the spacer shown in FIG. 2A.
Figure 2H:
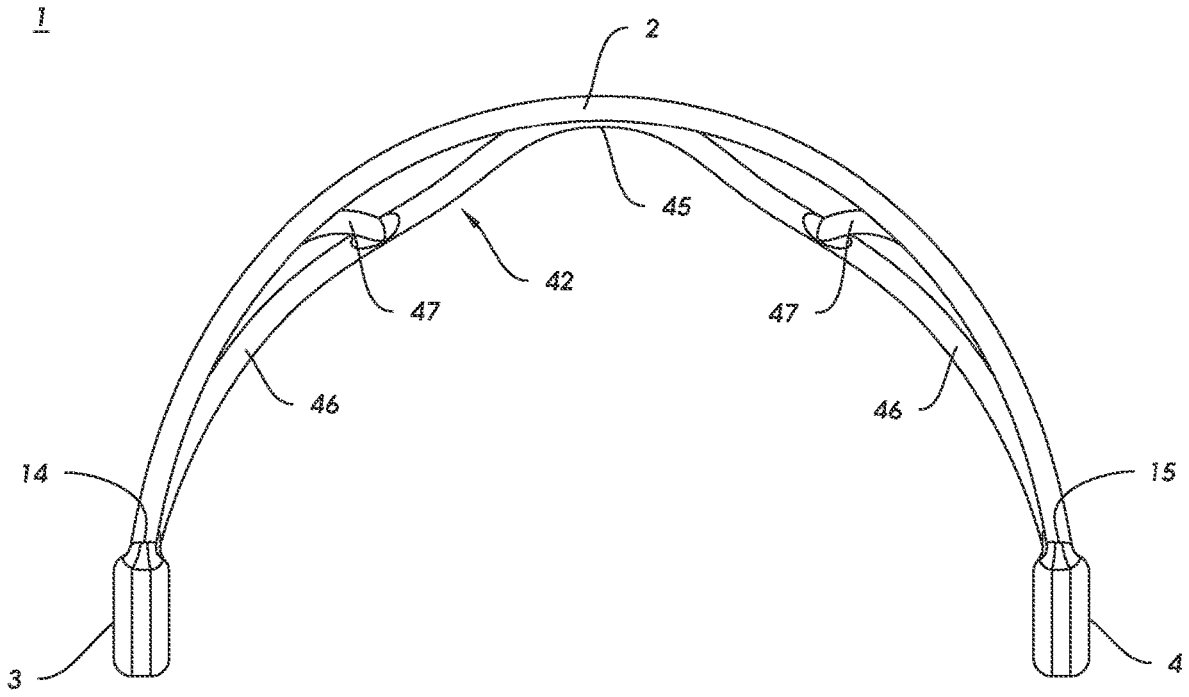
FIG. 2H is a bottom view of the particular embodiment of the spacer shown in FIG. 2A.

Now referring primarily to FIGS. 1A and 1B, which illustrate a particular embodiment of the inventive spacer (1) including a shape-retaining first support member (2) outwardly and downwardly extending between first and second attachment points (3) (4), whereby the first support member (2) can be configured for disposition in front of a face (5) of a wearer (6) to distance (or separate) a face covering (7) from a mouth (8) of the wearer (6), correspondingly creating a space therebetween. The first and second attachment points (3) (4) can be configured to releasably couple the first support member (2) to eyewear (9), such as eyeglasses, sunglasses, safety glasses, or goggles (10), and/or headwear (11), such as a hat or helmet (12).

In use, the spacer (1) may preclude direct contact between the face covering (7) and the mouth (8) of the wearer (6). Additionally, the spacer (1) can create an air pocket (or a functional airspace) between the face covering (7) and the mouth (8) of the wearer (6), which may advantageously make breathing considerably easier for the wearer (6), reduce moisture accumulation and/or ice formation on the face covering (7), reduce fogging of eyewear (9), preclude the face covering (7) from being drawn into the mouth (8) of the wearer (6) with inhalation, etc. Moreover, the spacer (1) can add a measure of tension to the face covering (7), which may assist in maintaining its position on the face (5) of the wearer (6).

Overall, the spacer (1) may be comfortable and ergonomically designed, and may not interfere with (i) normal freedom of movement of the head, (ii) line of sight, (iii) central vision, and/or (iv) peripheral vision of the wearer (6). As to particular embodiments, the spacer (1) may not generally contact or rest against the mouth (8) of the wearer (6). Further, as to particular embodiments, the spacer (1) may not generally contact or rest against the face (5) of the wearer (6).

To assist in the description of the instant spacer (1), terms such as top, bottom, front, rear, right, and left can be used to describe the accompanying figures. It will be appreciated, however, that the spacer (1) may be otherwise oriented and the relative descriptors can be interpreted accordingly.

Spatially relative terms, such as "below," "lower," "above," "upper," and the like, may be used herein for ease of description to describe an element's relationship to another element when the spacer (1) is right side up as shown in the accompanying figures and with respect to the spacer (1) being worn by a wearer (6) as intended with the wearer (6) standing upright. Thus, an upper component of the spacer (1) would be located closer to the top of the head of the wearer (6), and a lower component of the spacer (1) would be located closer to the neck (13) of the wearer (6). Likewise, the right side of the spacer (1) would be located adjacent to the right side of the face (5) of the wearer (6), and the left side of the spacer (1) would be located adjacent to the left side of the face (5) of the wearer (6).

As used herein, terms such as "first," "second," etc. may be used to describe various elements, but these elements should not necessarily be limited by these terms, as these terms are used to distinguish one element from another element. Following, a "first" element could also be termed a "second" element and a "second" element could also be termed a "first" element without departing from the teachings of the present disclosure.

Now referring primarily to FIGS. 2A through 2H, and FIGS. 8A through 9D, the spacer (1) includes a first support member (2) which can be shape-retaining, meaning that the first support member (2) can maintain its predefined three-dimensional shape independently or substantially independently. The first support member (2) can have a length which extends (i) between opposing first support member first and second ends (14) (15) or (ii) from the first support member first end (14) to the first support member second end (15), whereby the first support member first end (14) can couple to, connect to, or be integrated with the first attachment point (3) and the first support member second end (15) can couple to, connect to, or be integrated with the second attachment point (4). In use, when coupled to eyewear (9) or headwear (11), the first support member first end (14) can dispose proximate the right temple of the wearer (6), and the first support member second end (15) can dispose proximate the left temple of the wearer (6).

As to particular embodiments, the length of the first support member (2) can be adjustable, for example relative to the first and second attachment points (3) (4), meaning shortened or lengthened as desired by the wearer (6), for example to contour to the face (5) of the wearer (6), to dispose the first support member (2) a desired distance in front of or beyond the face (5) of the wearer (6), etc.

The first support member (2) can outwardly extend between or from the first and second attachment points (3) (4); correspondingly, the first support member (2) can comprise a curve or arc between the first support member first and second ends (14) (15), whereby the curve can convexly bend or bow to facilitate the outward extension which disposes the first support member (2) in front of or beyond the face (5) of the wearer (6) to laterally traverse the face (5) and bridge the mouth (8) of the wearer (6) without contact when worn. As to particular embodiments, the first support member (2) may be described as generally U-shaped or having a U-shape.

Now referring primarily to FIGS. 3A and 3B, in addition to outwardly extending between the first and second attachment points (3) (4), the first support member (2) can downwardly extend between or from the first and second attachment points (3) (4) to facilitate disposition of the first support member (2) below a top plane (16) extending through the first and second attachment points (3) (4) and proximate the nose (17), mouth (8), jawline, or chin (18) of the wearer (6), depending upon the embodiment.

Following, as to particular embodiments, the first support member (2) can dispose downwardly and extend outwardly in front of or proximate the chin (18) of the wearer (6) to distance (or separate) the face covering (7) from the mouth (8) of the wearer (6), correspondingly creating a space therebetween. As to these particular embodiments, the first support member (2) disposes below the nose (17) and the mouth (8) of the wearer (6).

As to other particular embodiments, the first support member (2) can dispose downwardly and extend outwardly in front of or proximate the jawline of the wearer (6) to distance (or separate) the face covering (7) from the mouth (8) of the wearer (6), correspondingly creating a space therebetween.

As to yet other particular embodiments, the first support member (2) can dispose downwardly and extend outwardly in front of or proximate the mouth (8) of the wearer (6) to distance (or separate) the face covering (7) from the mouth (8) of the wearer (6), correspondingly creating a space therebetween. As to these particular embodiments, the first support member (2) disposes below the nose (17) and above the chin (18) of the wearer (6).

As to still yet other particular embodiments, the first support member (2) can dispose downwardly and extend outwardly in front of or proximate the nose (17) of the wearer (6) to distance (or separate) the face covering (7) from the mouth (8) of the wearer (6), correspondingly creating a space therebetween. As to these particular embodiments, the first support member (2) disposes above the mouth (8) and the chin (18) of the wearer (6).

Again referring primarily to FIGS. 3A and 3B, for further illustration, a set of reference planes is provided, specifically a top plane (16) through which a z-axis (19) passes, a front plane (20) through which an x-axis (21) passes, and a right plane (22) through which a y-axis (23) passes, whereby the top plane (16), the front plane (20), and the right plane (22) all pass through the first and second attachment points (3) (4), such as through a center of the first and second attachment points (3) (4), and share a common origin. As to particular embodiments, the x-axis (21) may be parallel with a horizontal direction, the y-axis (23) may be parallel with a vertical direction, and the z-axis (19) may be parallel with a direction normal to both the x-axis (21) and the y-axis (23). Now regarding the outward and downward extension of the first support member (2) between the first and second attachment points (3) (4), the first support member (2) can be disposed along an angled plane (24) between the top plane (16) and the front plane (20). Regarding axes, the outward and downward extension of the first support member (2) between the first and second attachment points (3) (4) can be between the positive (+) z-axis (19) and the negative (−) y-axis (23).

As to particular embodiments, the first support member (2) can extend along an angled plane (24) which disposes at an angle of about 45° from the top plane (16) and the positive (+) z-axis (19). Correspondingly, the first support member (2) extends along the angled plane (24) which disposes at an angle of about 45° from the front plane (20) and the negative (−) y-axis (23).

As to particular embodiments, the first support member (2) can extend along an angled plane (24) which disposes at an angle of less than about 45° from the top plane (16) and the positive (+) z-axis (19). Correspondingly, the first support member (2) extends along the angled plane (24) which disposes at an angle of greater than about 45° from the front plane (20) and the negative (−) y-axis (23).

As to particular embodiments, the first support member (2) can extend along an angled plane (24) which disposes at an angle of greater than about 45° from the top plane (16) and the positive (+) z-axis (19). Correspondingly, the first support member (2) extends along the angled plane (24) which disposes at an angle of less than about 45° from the front plane (20) and the negative (−) y-axis (23).

As but one illustrative example, the first support member (2) can extend along an angled plane (24) which disposes at an angle of about 50° from the top plane (16) and the positive (+) z-axis (19). Correspondingly, the first support member (2) extends along the angled plane (24) which disposes at an angle of about 40° from the front plane (20) and the negative (−) y-axis (23).

As to particular embodiments, the first support member (2) can be substantially planar; however, the first support member (2) need not be planar, thus a portion of the first support member (2) can dispose above and/or below the angled plane (24).

As to particular embodiments, the first support member (2) can extend sufficiently downwardly between the first and second attachment points (3) (4) such that the first support member (2) disposes below the eyes (25) of the wearer (6) and does not interfere with (i) line of sight, (ii) central vision, and/or (iii) peripheral vision of the wearer (6).

As to particular embodiments, the first support member (2) can extend sufficiently outwardly and downwardly between the first and second attachment points (3) (4) to space the face covering (7) from the mouth (8) of the wearer (6) by a distance of at least about 0.5 inches.

As to particular embodiments, the first support member (2) can extend sufficiently outwardly and downwardly between the first and second attachment points (3) (4) to space the face covering (7) from the mouth (8) of the wearer (6) by a distance of at least about 0.75 inches.

As to particular embodiments, the first support member (2) can extend sufficiently outwardly and downwardly between the first and second attachment points (3) (4) to space the face covering (7) from the mouth (8) of the wearer (6) by a distance of at least about 1 inch.

As to particular embodiments, the first support member (2) can extend sufficiently outwardly and downwardly between the first and second attachment points (3) (4) to space the face covering (7) from the mouth (8) of the wearer (6) by a distance of at least about 1.25 inches.

As to particular embodiments, the first support member (2) can extend sufficiently outwardly and downwardly between the first and second attachment points (3) (4) to space the face covering (7) from the mouth (8) of the wearer (6) by a distance of at least about 1.5 inches.

As to particular embodiments, the first support member (2) can extend sufficiently outwardly and downwardly between the first and second attachment points (3) (4) to space the face covering (7) from the mouth (8) of the wearer (6) by a distance of at least about 1.75 inches.

As to particular embodiments, the first support member (2) can extend sufficiently outwardly and downwardly between the first and second attachment points (3) (4) to space the face covering (7) from the mouth (8) of the wearer (6) by a distance of at least about 2 inches.

As to particular embodiments, the first support member (2) can extend sufficiently outwardly and downwardly between the first and second attachment points (3) (4) to space the face covering (7) from the mouth (8) of the wearer (6) by a distance of at least about 2.25 inches.

As to particular embodiments, the first support member (2) can extend sufficiently outwardly and downwardly between the first and second attachment points (3) (4) to space the face covering (7) from the mouth (8) of the wearer (6) by a distance of at least about 2.5 inches.

The actual size and curvature of the first support member (2) may vary depending on (i) the eyewear (9) or the headwear (11) to which it is intended to couple thereto, and/or (ii) the intended wearer (6) and their corresponding facial dimensions, shape, and structures, and/or (iii) the face covering (7) which the first support member (2) is intended to space from the mouth (8) of the wearer (6).

The first support member (2) can be formed with the desired curvature made during the manufacturing process and be ready for immediate use, or the first support member (2) can be formed as a straight piece and be bendable by a wearer (6) so as to fit varying facial dimensions, shapes, and structures, depending upon the embodiment. However, in all embodiments, the first support member (2) provides the requisite support and rigidity to space the face covering (7) from the mouth (8) of the wearer (6) as the wearer (6) breaths and performs activities with the spacer (1) coupled to eyewear (9) or headwear (11).

To provide the requisite support and rigidity, the first support member (2) can be formed from a numerous and wide variety of materials, such as plastics, wires, rubbers, plant materials (e.g., bamboo resin), metals, rods, braided cables, combinations thereof, or the like. As to particular embodiments, the first support member (2) can have a high-friction coating which can prevent slippage of the face covering (7) during use. Regardless of material, the first support member (2) can be relatively thin, such as not greater than about 0.1 inches, not greater than about 0.2 inches, not greater than about 0.3 inches, not greater than about 0.4 inches, not greater than about 0.5 inches, not greater than about 0.75 inches, not greater than about 1 inch, not greater than about 1.25 inches, not greater than about 1.5 inches, not greater than about 1.75 inches, not greater than about 2 inches, not greater than about 2.25 inches, or not greater than about 2.5 inches, depending upon the embodiment.

As to particular embodiments which may be bendable by a wearer (6), the first support member (2) can comprise an elongated piece of shape-retaining deformable material having a cover, such as a twist tie device detailed in U.S. Pat.

Nos. 8,387,216, 8,776,322, and 8,806,723, all of which are hereby incorporated by reference herein in their entirety.

Now referring primarily to FIGS. 2A through 2H, 5A through 6B, and 8A through 10B, the spacer (1) can include first and second attachment points (3) (4) configured to releasably couple the first support member (2) to eyewear (9) or headwear (11), whereby the first support member (2) outwardly and downwardly extends between the first and second attachment points (3) (4), as detailed above.

As used herein, the term "releasable," which may be synonymous with removable and/or detachable, means capable of being relatively easily separated without destroying the integrity of the separated pieces. For example, the first support member (2) can be releasably coupled to eyewear (9) or headwear (11) and as such, can be relatively easily separated from the eyewear (9) or the headwear (11) without destroying the integrity of the first support member (2) or the eyewear (9) or the headwear (11).

As to particular embodiments, the first attachment point (3) can couple to, connect to, or be integrated with the first support member first end (14) and the second attachment point (4) can couple to, connect to, or be integrated with the first support member second end (15).

The first and second attachment points (3) (4) can provide a surface to which an attachment element can be coupled; specifically a first attachment element (26) can couple to the first attachment point (3) and a second attachment element (27) can couple to the second attachment point (4). As to particular embodiments, the first attachment element (26) can be connected to the first attachment point (3) and the second attachment element (27) can be connected to the second attachment point (4). As to particular embodiments, the first attachment element (26) can be integrated with the first attachment point (3) and the second attachment element (27) can be integrated with the second attachment point (4).

The first and second attachment elements (26) (27) can be configured to releasably couple the first support member (2) to eyewear (9) or headwear (11); following, each of the first and second attachment elements (26) (27) can comprise an attachable pair of components (A) (B), one couplable to the respective first or second attachment point (3) (4) and the other couplable to the eyewear (9) or the headwear (11). As to particular embodiments, the first and second attachment elements (26) (27) can releasably couple the first support member (2) to opposing sides of the eyewear (9) or the headwear (11). As but a first illustrative example, the first and second attachment elements (26) (27) can releasably couple the first support member (2) to glasses, such as eyeglasses, sunglasses, safety glasses, etc. (not shown), whereby attachment can be to a frame of the glasses. As but a second illustrative example, the first and second attachment elements (26) (27) can releasably couple the first support member (2) to goggles (10), such as ski or snowboard goggles (as shown in the example of FIGS. 5A, 5B, and 10A), etc., whereby attachment can be to a frame (28) or a strap (29) of the goggles (10), depending upon the embodiment. As but a third illustrative example, the first and second attachment elements (26) (27) can releasably couple the first support member (2) to a hat, such as a cap, a beanie, etc. (not shown), or a visor (not shown), whereby attachment can be to a bill, a brim, a crown, a body, etc., depending upon the embodiment. As but a fourth illustrative example, the first and second attachment elements (26) (27) can releasably couple the first support member (2) to a helmet (12), such as a ski helmet (as shown in the example of FIGS. 6A, 6B, and 10B), etc., whereby attachment can be to a shell (30) or a strap of the helmet (12), depending upon the embodiment.

The first and second attachment elements (26) (27) can be any of a numerous and wide variety of coupling mechanisms, such as mechanical fasteners, interlocking fasteners, clips, clamps, magnets, snaps, ties, buttons, zippers, threaded fasteners, hooks, loops, hook and loop fasteners (such as VELCRO®), interference fits, twist locks, detents, buckles, pressure fit connections, adhesives, combinations thereof, or the like.

As to particular embodiments, the first and second attachment elements (26) (27) can comprise magnets. As but one illustrative example, the first and second attachment elements (26) (27) can be provided by a mechanical-magnetic connecting structure (31). Each mechanical-magnetic connecting structure (31) can include a first connecting module (32) and a second connecting module (33) which can be arranged on each other in a closing direction and can be mechanically latched to each other in a closed position. Additionally, the mechanical-magnetic connecting structure (31) can include magnetic means which establish a magnetic attraction force between the first and second connecting modules (32) (33) to assist the transfer of the first and second connecting modules (32) (33) into the closed position. The first connecting module (32) can be released from the second connecting module (33) by means of a movement of the first connecting module (32) or a part of the first connecting module (32) in an opening direction that differs from the closing direction, whereby the magnetic means counteract movement of the first connecting module (32) in the opening direction.

As but one illustrative example, the mechanical-magnetic connecting structure (31) can be similar to that disclosed in U.S. Pat. No. 8,794,682, which is hereby incorporated by reference herein in its entirety.

As but a second illustrative example, the mechanical-magnetic connecting structure (31) can be a SNAP fastener, such as a SNAP buckle, which can be obtained from Fidlock GmbH, Hindenburgstraße 37, 30175 Hannover, Germany. Of course, any mechanical-magnetic connecting structure (31) having a similar functionality to this product may also be used, such as any product which combines a magnetic fastener with a mechanical snap or buckle fastener.

As to particular embodiments, the first attachment element (26) can comprise a first connecting module (32) which couples to the first attachment point (3) and a second connecting module (33) which couples to the eyewear (9) or the headwear (11). Correspondingly, the second attachment element (27) can comprise a first connecting module (32) which couples to the second attachment point (4) and a second connecting module (33) which couples to the eyewear (9) or the headwear (11).

As to other particular embodiments, the first attachment element (26) can comprise a second connecting module (33) which couples to the first attachment point (3) and a first connecting module (32) which couples to the eyewear (9) or the headwear (11). Correspondingly, the second attachment element (27) can comprise a second connecting module (33) which couples to the second attachment point (4) and a first connecting module (32) which couples to the eyewear (9) or the headwear (11).

Now referring primarily to FIGS. 1B, 4A through 4C, and 7A through 7C, a face covering (7) can be supported in front of the face (5) of the wearer (6) and distanced (or separated) from the mouth (8) of the wearer (6) by the first support member (2), whereby the face covering (7) can cover a portion of the face (5) of the wearer (6) without covering the eyes (25) of the wearer (6) so as to not interfere with (i) line of sight, (ii) central vision, and/or (iii) peripheral vision of the wearer (6).

The face covering (7) can comprise any of a numerous and wide variety of materials, such as rigid materials, semi-rigid materials, flexible materials, fabrics, cloths, textiles, woven materials, nonwoven materials, knit materials, combinations thereof, or the like. As to particular embodiments, the face covering (7) can be reusable. As to particular embodiments, the face covering (7) can be washable.

Now referring primarily to FIGS. 1B, and 4A through 4C, as to particular embodiments, the face covering (7) can comprise a fabric panel (34) having a fabric panel length (35) extending between fabric panel upper and lower ends (36) (37), and a fabric panel width (38) extending between fabric panel left and right sides (39) (40). Regarding the latter, the fabric panel width (38) can be sufficient to span the first support member (2) from proximate the first attachment point (3) to proximate the second attachment point (4) to cover the portion of the face (5) of the wearer (6) disposing therebetween, which may include the nose (17), the chin (18), and the cheeks of the wearer (6). As but a first illustrative example, the fabric panel width (38) can be in a range of about 1 inch to about 32 inches. As but a second illustrative example, the fabric panel width (38) can be in a range of about 6 inches to about 12 inches. As but a third illustrative example, the fabric panel width (38) can be about 9 inches.

The fabric panel length (35) can be sufficient to extend downwardly and cover at least a portion of the front of the neck (13) of the wearer (6). As to particular embodiments, the fabric panel length (35) can be sufficient to extend downwardly and cover the entirety of the front of the neck (13) of the wearer (6). As to particular embodiments, the fabric panel length (35) can be sufficient to extend downwardly beyond the front of the neck (13) of the wearer (6). As to particular embodiments, the fabric panel length (35) can be sufficient to extend downwardly to proximate the front of the shoulders of the wearer (6). As to particular embodiments, the fabric panel length (35) can be sufficient to extend downwardly beyond the front of the shoulders of the wearer (6). As but a first illustrative example, the fabric panel length (35) can be in a range of about 1 inch to about 32 inches. As but a second illustrative example, the fabric panel length (35) can be in a range of about 8 inches to about 16 inches. As but a third illustrative example, the fabric panel length (35) can be about 12 inches.

As to particular embodiments, the fabric panel (34) can have a generally rectangular shape; however, the fabric panel (34) need not be limited to this shape and can have any of a numerous and wide variety of other shapes suitable for covering a portion of the face (5) of the wearer (6), depending upon the embodiment.

Now referring primarily to FIGS. 7A through 7C, as to particular embodiments, the face covering (7) can comprise a fabric sleeve (41) which may be vertically tubular and configured to protect the face (5) and the neck (13) of the wearer (6) from cold conditions and/or the sun and/or airborne pathogens. Typically, to don, the fabric sleeve (41) can be slid over the head of the wearer (6) and onto their face (5) and neck (13). As to particular embodiments, the face covering (7) can comprise a buff (manufactured by Original Buff, S.A. in Spain and sold under the BUFF® brand) or a neck gaiter.

As to particular embodiments, the face covering (7) can be integrated with the spacer (1), such as permanently attached to the spacer (1).

As to other particular embodiments, the face covering (7) can releasably couple to the spacer (1), such as by any of a numerous and wide variety of coupling mechanisms, such as mechanical fasteners, interlocking fasteners, clips, clamps, magnets, snaps, ties, buttons, zippers, threaded fasteners, hooks, loops, hook and loop fasteners (such as VELCRO®), interference fits, twist locks, detents, buckles, pressure fit connections, adhesives, combinations thereof, or the like.

As to particular embodiments, the face covering (7) can releasably attach directly to the spacer (1), such as via one of the coupling mechanisms detailed above. As to other particular embodiments, the face covering (7) can fold over or wrap around a portion of the spacer (1) and releasably attach to itself to secure the face covering (7) on the spacer (1). As to yet other particular embodiments, the face covering (7) can comprise a channel through which a portion of the spacer (1) can be fed to releasably attached the face covering (7) to the spacer (1); as such, the face covering (7) can be slid onto the portion of the spacer (1) to secure the face covering (7) to the spacer (1). As to still yet other particular embodiments, the face covering (7) can releasably attach to the spacer (1) by tension and/or friction, which may be applicable to the embodiments of the face covering (7) configured as a fabric sleeve (41) detailed above.

Now referring primarily to FIGS. 2A through 2H, as to particular embodiments, the spacer (1) can, but need not necessarily, further include a shape-retaining second support member (42) outwardly and downwardly extending between the first and second attachment points (3) (4), whereby the second support member (42) can be configured for disposition in front of the face (5) of the wearer (6).

Akin to the first support member (2), the second support member (42) can have a length which extends (i) between opposing second support member first and second ends (43) (44) or (ii) from the second support member first end (43) to the second support member second end (44), whereby the second support member first end (43) can couple to, connect to, or be integrated with the first attachment point (3) and the second support member second end (44) can couple to, connect to, or be integrated with the second attachment point (4). In use, when coupled to eyewear (9) or headwear (11), the second support member first end (43) can dispose proximate the right temple of the wearer (6), and the second support member second end (44) can dispose proximate the left temple of the wearer (6).

Again akin to the first support member (2), the second support member (42) can outwardly extend between or from the first and second attachment points (3) (4); correspondingly, the second support member (42) can comprise a curve or arc between the second support member first and second ends (43) (44), whereby the curve can convexly bend or bow to facilitate the outward extension which disposes the second support member (42) in front of or beyond the face of the wearer (6) to laterally traverse the face (5) of the wearer (6) without contact when worn. As to particular embodiments, the second support member (42) may be described as generally U-shaped or having a U-shape.

Yet again akin to the first support member (2), in addition to outwardly extending between the first and second attachment points (3) (4), the second support member (42) can downwardly extend between or from the first and second attachment points (3) (4) to facilitate disposition of the second support member (42) below the top plane (16) extending through the first and second attachment points (3) (4).

As with the first support member (2), the second support member (42) can be disposed along an angled plane (not shown) between the top plane (16) and the front plane (20). Regarding axes, the outward and downward extension of the second support member (42) between the first and second attachment points (3) (4) can be between the positive (+) z-axis (19) and the negative (−) y-axis (23).

As to particular embodiments, the second support member (42) can extend along an angled plane which disposes at an angle of about 45° from the top plane (16) and the positive (+) z-axis (19). Correspondingly, the second support member (42) extends along the angled plane which disposes at an angle of about 45° from the front plane (20) and the negative (−) y-axis (23).

As to particular embodiments, the second support member (42) can extend along an angled plane which disposes at an angle of less than about 45° from the top plane (16) and the positive (+) z-axis (19). Correspondingly, the second support member (42) extends along the angled plane which disposes at an angle of greater than about 45° from the front plane (20) and the negative (−) y-axis (23).

As to particular embodiments, the second support member (42) can extend along an angled plane which disposes at an angle of greater than about 45° from the top plane (16) and the positive (+) z-axis (19). Correspondingly, the second support member (42) extends along the angled plane which disposes at an angle of less than about 45° from the front plane (20) and the negative (−) y-axis (23).

As but one illustrative example, the second support member (42) can extend along an angled plane which disposes at an angle of about 30° from the top plane (16) and the positive (+) z-axis (19). Correspondingly, the second support member (42) extends along the angled plane (24) which disposes at an angle of about 60° from the front plane (20) and the negative (−) y-axis (23).

Again as with the first support member (2), as to particular embodiments, the second support member (42) can be substantially planar; however, the second support member (42) need not be planar, thus a portion of the second support member (42) can dispose above and/or below the angled plane (24).

Yet again as with the first support member (2), as to particular embodiments, the second support member (42) can extend sufficiently downwardly between the first and second attachment points (3) (4) such that the second support member (42) disposes below the eyes (25) of the wearer (6) and does not interfere with (i) line of sight, (ii) central vision, and/or (iii) peripheral vision of the wearer (6).

Still yet again as with the first support member (2), the actual size and curvature of the second support member (42) may vary depending on (i) the eyewear (9) or the headwear (11) to which it is intended to couple thereto, and/or (ii) the intended wearer (6) and their corresponding facial dimensions, shape, and structures, and/or (iii) the face covering (7).

The second support member (42) can be made as detailed above for the first support member (2).

Again referring primarily to FIGS. 2A through 2H, the first and second support members (2) (42) can be disposed in vertically spaced-apart relation. Regarding relative relations, the second support member (42) can be located above the first support member (2) or, said another way, the first support member (2) can be located below the second support member (42). Following, the first support member (2) can provide a lower support member and the second support member (42) can provide an upper support member.

As an upper support member, as to particular embodiments, the second support member (42) can dispose proximate the nose (17) of the wearer (6). Hence, the second support member (42) can comprise a central portion contoured about the nose (17) of the wearer (6) to bridge the nose (17), hereinafter a nose bridge (45). Further, the second support member (42) can comprise two legs (46) laterally extending from opposing sides of the nose bridge (45), whereby the nose bridge (45) can upwardly extend from the legs (46). As to particular embodiments, the nose bridge (45) can be triangular in shape and the legs (46) may be shaped such that they extend rearward from the nose bridge (45) and generally follow a contour of the face (5) of the wearer (6). The nose bridge (45) may or may not contact the nose (17) of the wearer (6) when worn, depending upon the embodiment.

Again referring primarily to FIGS. 2A through 2H, as to particular embodiments, the first and second support members (2) (42) may converge proximate the first and second attachment points (3) (4).

As to particular embodiments, the spacer (1) can, but need not necessarily, further include one or more additional laterally extending support members outwardly and downwardly extending between the first and second attachment points (3) (4) for disposition in front of the face (5) of the wearer (6), whereby the additional support members can be located in spaced-apart relation to the first and second support members (2) (42).

Again referring primarily to FIGS. 2A through 2H, as to particular embodiments, the spacer (1) can, but need not necessarily, further include one or more intermediate support members (47) disposed between the first and second support members (2) (42) and/or extending between the first and second support members (2) (42), whether vertically or in angled relation. As to particular embodiments, when a plurality of intermediate support members (47) are present, they can be disposed in horizontally spaced-apart relation to one another, the spacing being equal or variable, depending upon the embodiment.

As to particular embodiments, the spacer (1) can be movable, such as pivotable or rotatable, relative to the eyewear (9) or the headwear (11). For example, the spacer (1) can be moved, pivoted, or rotated upward to a forehead region, top of the head, back of the head, etc. of the wearer (6), such as for stowing on the wearer (6) when not in use. Following, for use, the spacer (1) can be moved, pivoted, or rotated downward to dispose the first support member (2) in front of or beyond the face (5) of the wearer (6).

As to particular embodiments, one or more components of the spacer (1) can be movable, such as pivotable or rotatable, relative to another. As a first illustrative example, the first support member (2) can be moved, pivoted, or rotated relative to the first and second attachment points (3) (4), the first and second attachment elements (26) (27), the eyewear (9), or the headwear (11), as desired by the wearer (6), such as for angular adjustment. As a second illustrative example, the first support member (2) can be moved, pivoted, or rotated relative to the second support member (42) as desired by the wearer (6), such as for angular adjustment. As a third illustrative example, the second support member (2) can be moved, pivoted, or rotated relative to the first and second attachment points (3) (4), the first and second attachment elements (26) (27), the eyewear (9), or the headwear (11), as desired by the wearer (6), such as for angular adjustment. As a fourth illustrative example, the second support member (42) can be moved, pivoted, or rotated relative to the first support member (2) as desired by the wearer (6), such as for angular adjustment.

As to particular embodiments, the spacer (1) can be compactable and/or stowable, whereby the spacer (1) may collapse, telescope, fold, wrap, coil, disassemble, or otherwise transform from a first state to a second state that is more compact than the first state.

As to particular embodiments, the spacer (1) can include a one-way breathing valve, which may include a mouthpiece, an intake port, and an exhaust port. Fresh air can be inducted through the intake port and then pass through the mouthpiece to a user, and expired breath can be exhausted through the mouthpiece and then out of the one-way breathing valve through the exhaust port. As to particular embodiments, the one-way breathing valve can include one or more internal baffles or diaphragms to facilitate the one-way air flow.

As to particular embodiments, the one-way breathing valve can be attached to the spacer (1). Correspondingly, the face covering (7) can include a front opening which allows the mouthpiece to pass therethrough. A perimeter of the front opening can include elastic or a tie to allow the front opening to cinch or otherwise secure around an exterior surface of the one-way breathing valve.

As to particular embodiments, the one-way breathing valve can attach to the face covering (7). As to particular embodiments, the one-way valve can be a diaphragm-style valve; for example, the one-way valve can have a diaphragm sandwiched between inner and outer structural members. The one-way valve can allow exhaled breath containing water vapor to exhaust through a front opening in the face covering (7). Fresh air can be drawn into the air pocket directly through the face covering (7) or via the periphery of the face covering (7).

As to particular embodiments, the spacer (1) including the first support member (2), the first and second attachment points (3) (4), and optionally the second support member (42), additional laterally extending support members, and/or one or more intermediate support members (47) can be made as a single or one-piece or monolithic construct from any appropriate method, such as molding, injection molding, additive printing, casting, machining, etc.

As to particular embodiments, the spacer (1) can be provided as a standalone accessory for use with a face covering (7) and eyewear (9) or headwear (11). As to particular embodiments, the spacer (1) can be integrated with the face covering (7). As to particular embodiments, the spacer (1) can be integrated with the eyewear (9) or the headwear (11). As to other particular embodiments, the spacer (1) can be integrated with the face covering (7) and the eyewear (9) or the headwear (11).

Using the spacer (1) can include releasably coupling the spacer (1) to eyewear (9) or headwear (11) via the first and second attachment points (3) (4); coupling a face covering (7) to the spacer (1); and wearing the eyewear (9) or the headwear (11). When worn, the first support member (2) which outwardly and downwardly extends between the first and second attachment points (3) (4) can dispose in front of the face (5) of the wearer (6) to space the face covering (7) from the mouth (8) of the wearer (6).

As can be easily understood from the foregoing, the basic concepts of the present invention may be embodied in a variety of ways. The invention involves numerous and varied embodiments of a face covering spacer for use with eyewear and headwear and methods for making and using such a face covering spacer.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a support" should be understood to encompass disclosure of the act of "supporting"—whether explicitly discussed or not—and, conversely, were there effectively disclosure of the act of "supporting", such a disclosure should be understood to encompass disclosure of "supporting" and even a "means for supporting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a protrusion" refers to one or more of those protrusions. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

As used herein with respect to an identified property or circumstance, "substantially" refers to a degree of deviation that is sufficiently small so as to not measurably detract from the identified property or circumstance. The exact degree of deviation allowable may in some cases depend on the specific context.

Thus, the applicant(s) should be understood to claim at least: i) each of the face covering spacers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice versa as necessary to define the matter for which protection is sought by this application or by any subsequent application or continuation, division, or continuation in part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation in part application thereof or any reissue or extension thereon.

The claims set forth in this specification are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A spacer for spacing a face covering from a mouth of a wearer, comprising:

a first attachment point;

a second attachment point;

a shape-retaining first support member coupled to said first and second attachment points, said first support member comprising a convex curve between first support member first and second ends which outwardly extends between said first and second attachment points; and a shape-retaining second support member coupled to said first and second attachment points, said second support member comprising a convex curve between second support member first and second ends which outwardly extends between said first and second attachment points;

wherein said second support member disposes above said first support member in vertically spaced-apart relation;

wherein said first support member outwardly extends beyond said second support member;

wherein said first and second attachment points are configured to releasably couple said first and second support members to eyewear and/or headwear; and wherein when said spacer is worn in front of a face of said wearer:

said first and second support members downwardly extend between said first and second attachment points to dispose below a top plane extending through said first and second attachment points; and said first and second support members dispose in front of said face of said wearer without contacting said face to distance said face covering from said mouth of said wearer to create a space therebetween.

2. The spacer of claim 1, wherein the downward extension of said first support member is configured to facilitate disposition of said first support member proximate a nose, said mouth, a jawline, or a chin of said wearer.

3. The spacer of claim 1, wherein, for the outward and downward extension, said first support member disposes along an angled plane between said top plane and a front plane.

4. The spacer of claim 3, wherein said top plane and said front plane both pass through said first and second attachment points.

5. The spacer of claim 1, wherein said first support member extends sufficiently downwardly between said first and second attachment points such that said first support member is configured to dispose below the eyes of said wearer.

6. The spacer of claim 1, further comprising:

a first attachment element which couples to said first attachment point; and a second attachment element which couples to said second attachment point.

7. The spacer of claim 6, wherein said first and second attachment elements are configured to releasably couple said first support member to goggles.

8. The spacer of claim 6, wherein said first and second attachment elements are configured to releasably couple said first support member to sunglasses.

9. The spacer of claim 6, wherein said first and second attachment elements comprise magnets.

10. The spacer of claim 6, wherein said first and second attachment elements are configured to releasably couple said first support member to a helmet.

11. The spacer of claim 1, further comprising said face covering;

wherein said face covering comprises a face covering length sufficient to extend downwardly and cover at least a portion of the front of a neck of said wearer.

12. The spacer of claim 1, further comprising said face covering;

wherein said face covering releasably couples to said spacer.

13. The spacer of claim 1, wherein, for the outward and downward extension, said second support member disposes along an angled plane between said top plane and a front plane.

14. The spacer of claim 13, wherein said top plane and said front plane both pass through said first and second attachment points.

15. The spacer of claim 1, wherein said second support member is configured to be disposed below the eyes of said wearer.

16. The spacer of claim 1, wherein said second support member is configured to be disposed proximate a nose of said wearer.

* * * * *